US008910719B2

(12) United States Patent
Kockeis et al.

(10) Patent No.: US 8,910,719 B2
(45) Date of Patent: Dec. 16, 2014

(54) APPARATUS AND METHOD OF HANDLING ROD-SHAPED COMPONENTS

(75) Inventors: Rupert Kockeis, Schonberg (DE); Hans-Peter Murr, Offenberg (DE); Tobias Stadler, Deggendorf (DE); Andreas Beck, Bogen (DE); Markus Heckendorf, Deggendorf (DE); Werner Gluck, Pilsting (DE); Georg Streicher, Lalling (DE); Marco Winter, Deggendorf (DE)

(73) Assignee: Max Streicher GmbH & Co. KG aA, Deggendorf (DE)

( * ) Notice: Subject to any disclaimer, the term of this patent is extended or adjusted under 35 U.S.C. 154(b) by 354 days.

(21) Appl. No.: 13/319,286

(22) PCT Filed: May 6, 2010

(86) PCT No.: PCT/EP2010/056210

§ 371 (c)(1),
(2), (4) Date: Dec. 21, 2011

(87) PCT Pub. No.: WO2010/128119

PCT Pub. Date: Nov. 11, 2010

(65) Prior Publication Data

US 2012/0097454 A1 Apr. 26, 2012

(30) Foreign Application Priority Data

May 7, 2009 (DE) ..... 10 2009 020 222

(51) Int. Cl.
*E21B 19/20* (2006.01)
*E21B 19/15* (2006.01)

(52) U.S. Cl.
CPC ..... *E21B 19/15* (2013.01); *E21B 19/155* (2013.01)
USPC ..... 166/380; 166/77.51; 166/85.1; 166/98; 175/52; 175/162; 414/22.55; 414/22.71

(58) Field of Classification Search
CPC ..... E21B 19/087; E21B 19/155; E21B 19/15; E21B 19/20
USPC ..... 166/379, 380, 382, 77.1, 77.4, 77.51, 166/77.52, 85.1, 98; 175/52, 162; 414/22.54, 22.55, 22.58, 22.71
See application file for complete search history.

(56) References Cited

U.S. PATENT DOCUMENTS 3,532,229 A 10/1970 Scaggs
3,916,500 A * 11/1975 Brown ..... 29/240

(Continued)

FOREIGN PATENT DOCUMENTS

AT 355531 3/1980
DE 1911986 11/1969

(Continued)

OTHER PUBLICATIONS

Third party petition filed on Dec. 16, 2013, in corresponding EP application.

*Primary Examiner* — Jennifer H Gay
(74) *Attorney, Agent, or Firm* — Boyle Fredrickson S.C.

(57) ABSTRACT

A device and a method for handling rod-shaped elements on drilling gear are disclosed. The device for handling rod-shaped elements on drilling gear includes a drill rod magazine on which the rod components are deposited between a center of a drill hole and a center of a drilling mast, an elevator with a guide that lifts the drill rods above a drill hole, and a drive for displacing the elevator, a gripper attached to the elevator for picking up the rod component from the drill rod magazine, and a plurality of monitors. The plurality of monitors automatically monitor the movement of the rod-shaped components amongst the magazine, the elevator, and the gripper.

40 Claims, 11 Drawing Sheets

(56) References Cited

U.S. PATENT DOCUMENTS

| | | | | |
|---|---|---|---|---|
| 3,986,618 | A * | 10/1976 | Woolslayer et al. | 414/745.9 |
| 4,274,778 | A * | 6/1981 | Putnam et al. | 414/22.71 |
| 4,591,006 | A * | 5/1986 | Hutchison et al. | 175/52 |
| 4,604,724 | A * | 8/1986 | Shaginian et al. | 700/213 |
| 4,621,974 | A * | 11/1986 | Krueger | 414/800 |
| 4,822,230 | A * | 4/1989 | Slettedal | 414/22.54 |
| 4,834,604 | A * | 5/1989 | Brittain et al. | 414/22.55 |
| 5,423,390 | A * | 6/1995 | Donnally et al. | 175/85 |
| 5,458,454 | A * | 10/1995 | Sorokan | 414/800 |
| 5,941,324 | A | 8/1999 | Bennett | |
| 6,079,925 | A * | 6/2000 | Morgan et al. | 414/22.57 |
| 6,220,807 | B1 * | 4/2001 | Sorokan | 414/22.62 |
| 6,705,414 | B2 * | 3/2004 | Simpson et al. | 175/52 |
| 6,926,488 | B1 * | 8/2005 | Bolding et al. | 414/22.62 |
| 7,042,555 | B1 | 5/2006 | Lawson | |
| 7,744,327 | B2 * | 6/2010 | Lops et al. | 414/22.52 |
| 7,802,636 | B2 * | 9/2010 | Childers et al. | 175/52 |
| 8,186,925 | B2 * | 5/2012 | Littlely | 414/22.55 |
| 8,186,926 | B2 * | 5/2012 | Littlely | 414/22.55 |
| 8,240,968 | B2 * | 8/2012 | Hopkins et al. | 414/22.55 |
| 8,251,151 | B2 * | 8/2012 | Haugen | 166/380 |
| 8,317,448 | B2 * | 11/2012 | Hankins et al. | 414/22.68 |
| 8,356,675 | B2 * | 1/2013 | Pietras et al. | 166/380 |
| 8,397,837 | B2 * | 3/2013 | Skogerbo | 175/52 |
| 8,584,773 | B2 * | 11/2013 | Childers et al. | 175/52 |
| 2006/0104747 | A1 | 5/2006 | Zahn et al. | |
| 2006/0151215 | A1 * | 7/2006 | Skogerbo | 175/52 |
| 2007/0261857 | A1 | 11/2007 | Kuttel et al. | |
| 2008/0101891 | A1 * | 5/2008 | Belik | 414/22.57 |
| 2008/0202812 | A1 * | 8/2008 | Childers et al. | 175/52 |
| 2008/0253866 | A1 | 10/2008 | Lops et al. | |
| 2009/0159294 | A1 * | 6/2009 | Abdollahi et al. | 166/377 |
| 2010/0104401 | A1 * | 4/2010 | Hopkins et al. | 414/22.54 |
| 2012/0097454 | A1 * | 4/2012 | Kockeis et al. | 175/57 |
| 2012/0217024 | A1 * | 8/2012 | Childers et al. | 166/380 |

FOREIGN PATENT DOCUMENTS

| | | |
|---|---|---|
| DE | 102 06 645 | 8/2003 |
| DE | 10 2004 004 315 | 8/2005 |
| GB | 2420362 | 1/2006 |
| GB | 2429994 | 8/2006 |
| RU | 1802070 | 3/1993 |
| SU | 1061700 | 2/1976 |
| SU | 1016474 | 5/1983 |
| SU | 1435749 | 11/1988 |
| SU | 1763634 | 9/1992 |
| WO | 02092959 | 11/2002 |
| WO | 2004018829 | 3/2004 |
| WO | 2007115375 | 10/2007 |

* cited by examiner

APPARATUS AND METHOD OF HANDLING ROD-SHAPED COMPONENTS

BACKGROUND OF THE INVENTION

1. Field of the Invention

The present invention relates to an apparatus and a method of handling rod-shaped components, especially for a deep-drilling device used either in the onshore region or in the offshore region. Such deep-drilling devices can be employed for vertical drilling in terms of the development of fields. The term "field" involves especially the occurrence of a substance in liquid, gaseous or solid form or the presence of energetically exploitable conditions in geological structures, especially with respect to crude oil, natural gas or geothermal energy. By the term "rod-shaped component" hereinafter especially, but not exclusively, those components are understood whose longitudinal expansion is larger than their transverse expansion. Those components are preferably in tubular shape and serve for introducing drillings, for instance.

Vertical drilling is preferably employed for exploiting oil and gas fields and for generating geothermal energy.

The principle of the present invention is not restricted to the use for deep drilling, but can also be employed, for instance, for other drilling devices, for example for horizontal drilling devices or tilted drilling devices.

2.Description of the Related Art

From the state of the art a vertical drilling device is known, for instance in accordance with the patent specification EP 1387924 B1 in which a plurality of pipes forming a pipeline in the ground are arranged substantially vertically on a drilling platform prior to being introduced. In said patent specification an apparatus and a method are described by which it is ensured that upon introducing or removing pipes a respective one of two pipes is safely held by a fastening means. A typical method of vertically arranging the pipes consists in a conveying system having a gripper and placing the pipes into the desired vertical position.

An improvement with respect to the method described in EP 1387924 B1 consists in using drill rod gripping systems as described in DE 102004004315 A1 and shown in FIG. 1. A drilling mast 1 is mounted on a base 2 made of individual segments. At the drilling mast 1*a* carriage at which a top drive is provided is movable in vertical direction. With a drill rod 6 provided below the top drive at the carriage 4, the same can be inserted into the drill hole and a corresponding drilling operation can be performed through the top drive. Adjacent to the base 2 and on ground level a drill rod magazine 8 is provided in which the drill rods to be introduced are stored and on which drill rods removed from the drill hole are deposited. In this application DE 102004004315 A1 a drill rod gripper 10 is provided at a guide frame 12 for facilitating the provision of the drill rod. This drill rod gripper grips a drill rod 6*a* located on the drill rod magazine 8 perpendicularly to the connecting line of the drilling mast and the drill hole, pivots the same perpendicularly thereto via a position of the drill rod shown by 6*b*, performs a translational movement along the guide frame 12 into the position shown by FIG. 6C, pivots into a position above the drill hole and then permits to introduce the drill rod into the drill hole through the top drive provided at the carriage 4. For removing a drill rod from the drill hole an inverse order of proceeding is chosen.

Although with such pipe handling system as described in DE 102004004315 A1 the risk of loads floating at a crane is dropped. On the other hand, however, manual cooperation of an operating person is necessary to ensure safe moving of the drill rods to the drill rod magazine in a first step, safe gripping by the drill rod gripper 10, safe pivoting to the prescribed position below the top drive and safe insertion of the drill rod into the drill hole.

It has to be noted that in the case of conventional onshore rigs introducing drill rods to the magazine 8 is frequently carried out manually or by forklifts, which additionally impedes a safe gripping of individual drill rods.

SUMMARY OF THE INVENTION

It is the object of the invention to provide an apparatus and a method of handling rod-shaped components, especially for deep-drilling devices, by which an automated and/or safe handling of the rod-shaped components, especially drill rods, is safeguarded until introduction thereof into a drill hole and from removal thereof from the drill hole. It is further preferred when the apparatus according to the invention and the method according to the invention for handling rod-shaped components can be realized both at onshore rigs and at offshore rigs.

This object is achieved by methods and apparatuses for handling rod-shaped components according to the independent claims. Developments according to the invention are the subject matter of the subclaims.

In accordance with the invention, an apparatus for handling rod-shaped components is provided which includes a depositing means for rod-shaped components in which rod-shaped components can be deposited, a lifting means having a lift carriage, a guide means for guiding the lift carriage and a drive for displacing the lift carriage, and a pick-up means mounted at the lift carriage for picking up a rod-shaped component from the depositing means, wherein the pick-up means is pivoting in respect of the lift carriage at a plane perpendicular to the displacing direction of the lift carriage such that a rod-shaped component can be arranged above a drill hole. In this way, the transport of rod-shaped components from the depositing means to above the drill hole can be carried out by one means and a height difference can be overcome. It is preferred that the rod-shaped components are adapted to be deposited in the depositing means substantially in parallel to a connecting line between the center of the drill hole and the center of the drilling mast. Such arrangement permits, apart from a compact construction of the rig including a depositing means, also a space-saving removal from the depositing means. The afore-mentioned apparatus for handling rod-shaped components is hereinafter referred to as basic structure.

According to the invention, further an apparatus for handling rod-shaped components is provided at a rig, preferably having the above basic structure, wherein this apparatus includes a transport means and a control means. The transport means is intended for the transport of the rod-shaped components from an intermediate depositing means to a depositing means for rod-shaped components, one or more rod-shaped components being adapted to be removed from the depositing means by a pick-up means. The control means is intended for controlling the transport means and by the former the transport means is controllable in such manner that a release of a rod-shaped component at the depositing means can be performed in response to a relative position of the transport means in respect of the depositing means. The afore-mentioned configuration of the apparatus can prevent the rig or facilities located in the vicinity thereof from being damaged or destroyed during a transport to the depositing means and can ensure depositing of the rod-shaped components with higher safety in the depositing means. In this way, already when introducing the rod-shaped components to the depositing means an increased safety can be brought about.

It is preferred that the above-mentioned apparatus comprises a detecting means for detection in respect of applying to the depositing means. It is preferred in this context that the relief at the transport means is detected. Upon detecting the relief at the transport means, for instance at a crane, it can be ensured that the rod-shaped component rests thereon and thus an uncontrolled downward movement of the rod-shaped component upon release by the transport means can be excluded with higher safety.

As an alternative or in addition thereto, in the afore-mentioned apparatus a detecting means can be provided at the depositing means which detects the application of one or more rod-shaped components to the depositing means. By such detection it can be ensured that the rod-shaped component is seated on the depositing means and not, for instance, due to uncontrolled tilting of the rod-shaped component on a portion in the vicinity of the depositing means.

It is further preferred that in the afore-mentioned apparatus the control means permits the release of the rod-shaped component(s) in response to a predetermined position relative to the depositing means. This dependence of the release on the relative position permits to determine a close region above the depositing means in which only a release can take place. In this way, it can be ensured also to a greater extent that the rod-shaped component is provided at a desired position at the depositing means.

The afore-mentioned apparatus can be further developed such that it comprises a detecting means for the position of the rod-shaped component(s) at the transport means relative to the depositing means. Moreover, a control means can allow, in response to an output signal from the detecting means for the relative position, a movement of the rod-shaped component or rod-shaped components at the transport means within a particular zone only. In this manner, it can be determined three-dimensionally in which zone the rod-shaped component can be provided above the depositing means and in a neighboring area. Thus, maloperation of the transport means and damage of the rig can be excluded with higher safety and the rig and the pipe handling can be automated to an increased extent.

It is preferred that with the afore-mentioned apparatus the detecting means for the relative position includes one or more position sensors at the transport means. Those position sensors are rotary encoders or length measuring systems, for instance. By such detection of the holding element for a rod-shaped component at the transport means the position of the rod-shaped component in space can be efficiently determined without a detection of the real position of the rod-shaped component being required by contact-free scanning, for instance. As an alternative, also the position of the rod-shaped component in space can be detected contact-free, as a matter of course, by mechanical elements, for instance a transport means.

The transport means preferably is a crane, whereby the tight space of an offshore rig, but also of an onshore rig, can be taken into account and maloperations, for instance during transport of the rod-shaped components by means of forklifts, can be excluded.

According to the invention, furthermore an apparatus for handling rod-shaped components at a rig, preferably according to the basic structure, is provided comprising a depositing means for rod-shaped components which includes at least one transfer means for individually removing the rod-shaped component by a pick-up means. Into such transfer means, which may be a transfer groove, for instance, a rod-shaped component can be introduced either by a transport means for the transport of the rod-shaped components to the depositing means or by a separating means provided in the depositing means in response to a detecting signal for the position of the rod-shaped component at the depositing means. Such separating means can include a lifting cylinder, for instance. When introducing the rod-shaped component into the transfer means by the transport means, a rod-shaped component can be introduced already in a fashion that a safe individual removal of the rod-shaped component by the pick-up means can be ensured. When using separating means at the depositing means, a plurality of rod-shaped components can initially be provided in the depositing means and in dependence on the position of an individual rod-shaped component a separation can be carried out at the depositing means. In this way, the requirements of accuracy during the transport of rod-shaped components to the depositing means can be reduced and still an individual pick-up of the rod-shaped components can be safeguarded by the pick-up means.

In the afore-mentioned apparatus it is preferred that the depositing means includes at least one conveying means having at least one catch disposed at a conveyor chain or a plurality of catches disposed at a conveyor chain by which a respective rod-shaped component can be transported by the pick-up means to the position of pick-up. In this way, a parallel arrangement of the rod-shaped components on the depositing means can be realized.

It is further preferred that the depositing means includes at least one conveying means by which at least two rod-shaped components can be transported to the transfer means. In this way, a rod-shaped component can be removed by the pick-up means and another rod-shaped component can be positioned in the depositing means by a transport means either simultaneously or slightly time-delayed.

Furthermore it is preferred when the depositing means includes a plurality of conveying means so that the rod-shaped components are movable by the conveying means at a minimum of two respective positions. In this manner, the rod-shaped components can be prevented from tilting in the depositing means.

It is especially preferred when the depositing means includes three conveying means and the depositing means is arranged in respect of the pick-up means in such manner that the rod-shaped component can be removed by the pick-up means between two conveying means and the depositing means. The storing of a rod-shaped component on three conveying means permits safe holding of the rod-shaped component in the case of the lengths of drill rods common especially in deep-rigs. Removal of the rod-shaped component between two of the three conveying means permits a removal outside the mass center and thus a facilitated transport of the rod-shaped component and a low construction height of a lifting means for the rod-shaped components at the pick-up means.

In accordance with the invention, furthermore an apparatus for handling rod-shaped components at a rig, preferably corresponding to the basic structure, is provided including a depositing means having a means for measuring the length of the rod-shaped component. The length measuring means includes either at least two mechanical detecting means by which the respective introduced rod-shaped component can be detected or includes a detecting means for contact-free detection of the rod-shaped component at a predetermined position. By mechanical detecting means the position of a rod-shaped component in the depositing means can be determined with acceptable accuracy and thus an exact removal by the pick-up means can be facilitated.

With contact-free detection of rod-shaped components at a predetermined position, a rod-shaped component can be safely detected at the predetermined position excluding mechanical errors of a mechanical detecting means.

The present apparatus is preferably further developed in such fashion that the mechanical detecting means includes a respective lever biased in an introducing recess for a rod-shaped component by the movement of which a detection signal can be triggered when the rod-shaped component is arranged. This simple mechanical design allows realizing a low-cost detecting system having a low failure rate.

It is further preferred when at least two detecting means for contact-free detection are provided by which portions of the rod-shaped component positioned opposed in longitudinal direction of the rod-shaped component can be detected. In this way, it can be found by a measuring operation in which direction a rod-shaped component deviates from the desired position of the rod-shaped component on the depositing means.

In the afore-mentioned apparatus it is preferred when the detecting means for contact-free detection includes a light barrier. In this way, a contact-free detection system can be realized at low cost.

It is further preferred in the apparatus according to the invention when the length measuring means includes, apart from the detecting means for contact-free detection, a moving means for moving the component introduced to the depositing means in its longitudinal direction or for moving the length measuring means in the longitudinal direction of the introduced rod-shaped component. In this way, either the rod-shaped component can be displaced to a desired position which can be determined by the length measuring means, or the exact position of the rod-shaped component can be established so that a pick-up means for gripping the rod-shaped component from the depositing means can grip the same at the desired position relative to its longitudinal direction.

Moreover, it is preferred when the length measuring means includes a control means by which the moving means can be controlled so that the rod-shaped component is arranged in the depositing means so as to be gripped by a pick-up means at a defined position. Thus, the length measuring means, the moving means and the control means can interact so as to bring about a defined state for pick-up by the pick-up means.

According to the invention, furthermore an apparatus for handling rod-shaped components at a rig, preferably corresponding to the afore-mentioned basic structure, is provided comprising a pick-up means by which the rod-shaped component can be picked up by plural, preferably two, pairs of gripper arms. Such pick-up means can include a detecting lever for the rod-shaped component in the pick-up means whose pivot is stationary with respect to a gripper arm. In this way, also in the case of rod-shaped components having different diameters the latter can be safely detected in the pick-up means.

It is preferred when in the afore-mentioned apparatus the lever is biased into the zone defined between the gripper arms, whereby the rod-shaped component provided in this zone can be detected by pressing the lever out of the zone between the gripper arms.

Further, according to the invention a control means can be provided to permit operation of the pick-up means only when a rod-shaped component is detected in the pick-up means. In this way, the error rate can be reduced and accidents can be avoided.

Moreover, in the afore-mentioned apparatus a pressure detecting means for the hydraulic control pressure or closing pressure for closing the gripper arms can be provided at the pick-up means, the control means permitting a movement of the pick-up means only when a rod-shaped component is detected in the pick-up means and in the case of the predetermined detected control pressure. It can be ensured in this way that not only when a rod-shaped component is detected in the pick-up means but also when a desired holding pressure for the rod-shaped component is provided by the pick-up means a movement of the rod-shaped component can take place so that the error rate of the total system can be reduced.

It is further preferred when one or more gripper arms are provided with detecting levers, the gripper arm(s) is/are preferably disposed opposed to the pick-up opening for the rod-shaped component. It can be prevented in this way that when the rod-shaped component is gripped only loosely by the front pair of gripper arms, the presence of the rod-shaped component in the pick-up means is erroneously detected and thus a safe transport of the rod-shaped component is not possible.

In the afore-mentioned apparatus it is further preferred when the gripper arms of each pair of gripper arms are mechanically connected such that they are only movable about the same respective angle. In this manner, a defined holding of the rod-shaped component by the pick-up means can be realized with a predetermined force and thus the transport can be rendered even more safely.

In accordance with the invention, moreover an apparatus for handling rod-shaped components at a rig, preferably exhibiting the basic structure, is provided, wherein it comprises a detecting means for the rod-shaped component at a lifting means disposed above the drill hole. In this manner, the handling of the rod-shaped component at a rig can be further automated and the error rate, for instance due to an uncontrolled downward movement of a rod-shaped component provided at the lifting means, can be reduced.

The afore-mentioned apparatus is preferably further developed in such fashion that the detecting means includes a mechanical lever mounted at the lifting means and being pivoting in a plane perpendicular to the lifting means which triggers a detecting means for the presence of the rod-shaped component in the lifting means. Thus, detection can be performed by simple mechanical means.

The afore-mentioned apparatus is preferably further developed in such fashion that the detecting means includes a sensor for the hydraulic pressure for safeguarding the closed state of the lifting means. Thus, the introduction of the rod-shaped component can be estimated based on the state of the lifting means. It is especially preferred when this is provided in addition to the mechanical lever, because the presence of the rod-shaped component in the lifting means can be detected on the basis of two detecting signals in this way.

It is further preferred that in the above-mentioned apparatus the detecting means includes a switch for detecting the closed holding means for the rod-shaped component at the lifting means. This once more increases the safety, because as an alternative or in addition to the afore-mentioned detecting means for the hydraulic pressure the closed state of the lifting means can be detected.

Further, the afore-mentioned apparatus can be developed in such way that it comprises a pick-up means for the rod-shaped component by which the rod-shaped component can be transferred to the lifting means and which is movable upward by the lifting means. In this apparatus in addition a control means is provided which allows a movement of the lifting means with the rod-shaped component independent of the pick-up means only after the pick-up means has been lifted above the rod-shaped component by the lifting means. In this way, it can be determined by mechanical coupling between the lifting means via the rod-shaped component to the pick-up means that the rod-shaped component is safely held by the lifting means above the drill hole. As a result, it is possible to release the pick-up means from the rod-shaped component with great safety without a risk of an uncontrolled downward movement of the rod-shaped component being given.

The present invention further relates to an apparatus for handling rod-shaped components at a rig, preferably exhibiting the basic structure as described above, wherein a detecting means for the position of the pick-up means and a control means are provided which permits opening of the pick-up means with introduced rod-shaped components only above the depositing means, preferably directly above or on the same and adjacent to a lifting means above the drill hole. In this way, the rod-shaped component on the pick-up means can be prevented from being released outside the desired zone and thus the safety of the rig can be increased.

It is preferred with such apparatus when the control means preferably permits in an area outside the position above the depositing means and preferably in an area adjacent to a lifting means above the drill hole that a hydraulic pressure is obtained for holding the rod-shaped component at the pick-up means. In this way, losses can be compensated without an undesired release of the rod-shaped component taking place.

In accordance with the invention, furthermore an apparatus for handling rod-shaped components at a rig, preferably corresponding to the basic structure, comprising two guide elements, preferably in the form of a double cone, for the rod-shaped component is provided by which the rod-shaped component provided in a guiding or centering means above the drill hole can be centered with respect to a rod-shaped component provided in the drill hole. By such centering an uncontrolled placing of a rod-shaped component onto a working platform or onto a rod provided in the drill hole can be prevented. Moreover, in this way also an automatic screwing of plural rod-shaped components above the drill hole can be performed.

It is preferred with such apparatus when the guide elements are movable along a synchronous path with respect to each other. This control permits an exact predetermination of the position for the rod-shaped component and requires only little efforts in terms of apparatuses.

According to the invention, further an apparatus for handling rod-shaped components at a rig, preferably corresponding to the basic structure, is provided comprising a lifting means provided above the drill hole and a control means by which the lifting means is controllable so that after an upward movement of the lifting means with rod-shaped components provided in the drill hole securing wedges can be removed, the removal of the wedges can be confirmed and the rod-shaped component can be further lowered or lifted into the drill hole or out of the same. In this manner, a controlled insertion of rod-shaped components into the drill hole or removal of the rod-shaped components from the drill hole can be realized with great safety.

DESCRIPTION OF THE PREFERRED EMBODIMENTS

Hereinafter the invention is described by way of the attached drawings.

Figure 1:
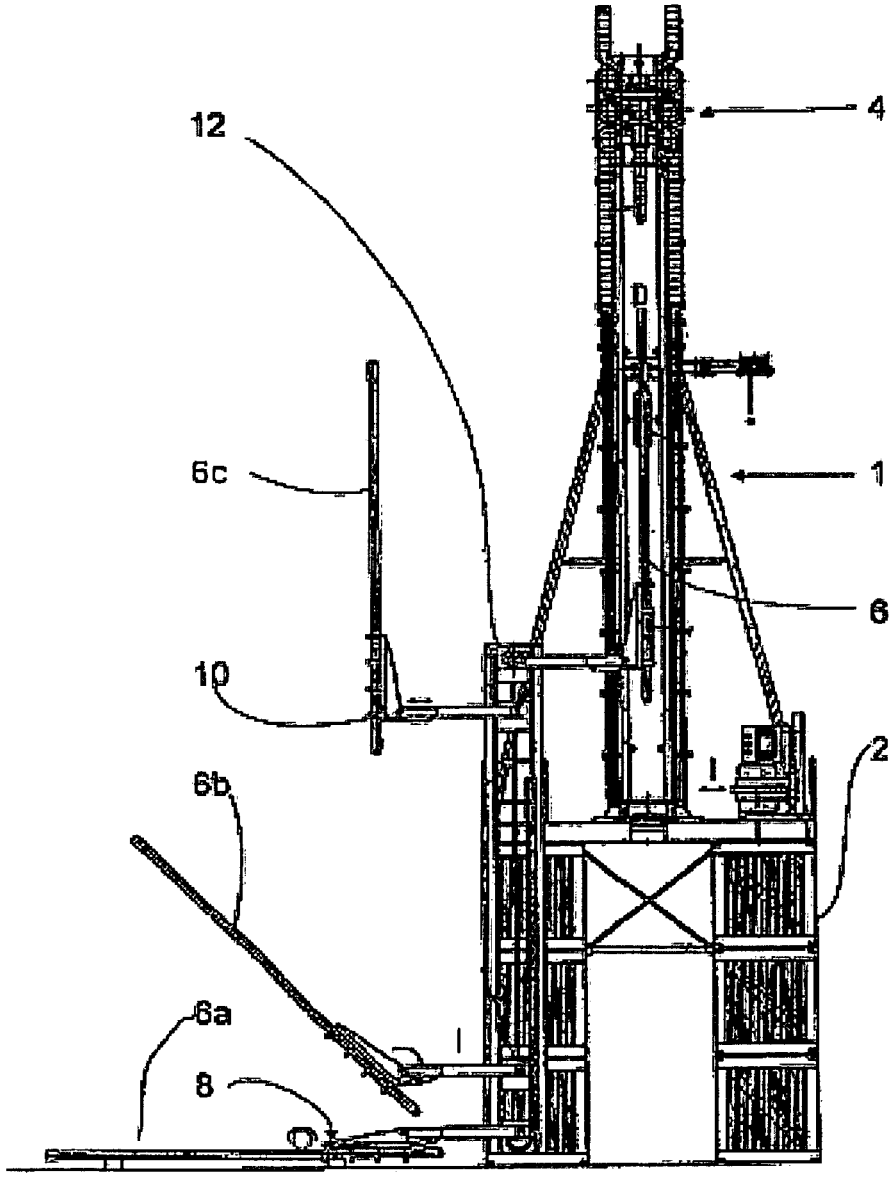
Fig. 1 PRIOR ART
FIG. 1 shows a front view of a rig according to the state of the art.
Figure 2:
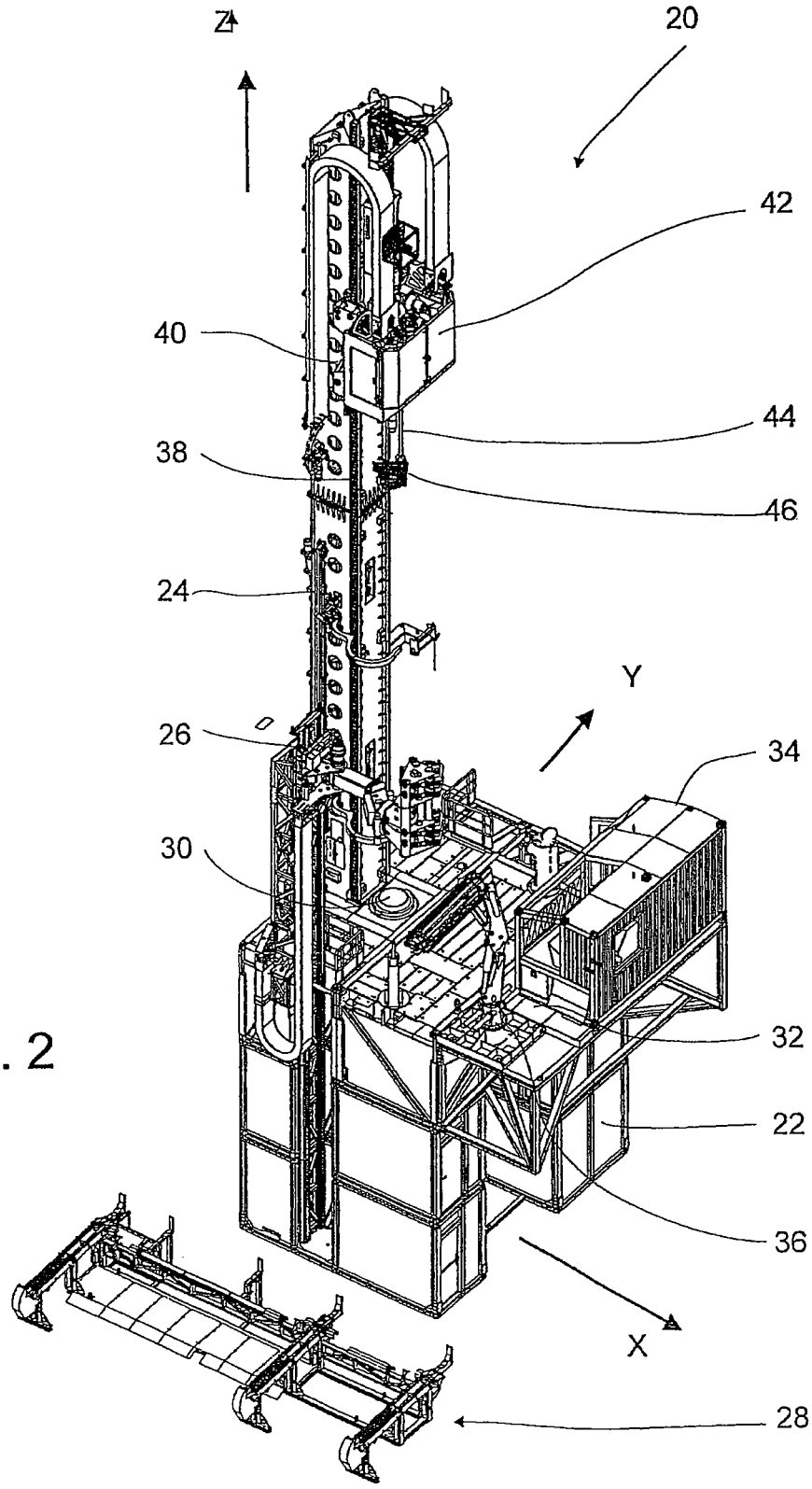
FIG. 2 shows a perspective view of a rig comprising the handling apparatus according to the invention.

FIG. 2 shows a perspective view of a rig 20 in which the apparatus for handling rod-shaped components and the method according to the invention for handling rod-shaped components can be realized. It has to be noted that when illustrating the rig in FIG. 2 a representation was chosen in which elements of the rig relevant to the handling of rod-shaped components and the environment thereof are shown. A rig, for instance for deep drilling, exhibits further details, however, such as e.g. a generator, electric control units, electric power distributing modules, pressure reservoirs and the like.

The rig 20 illustrated in FIG. 2 includes a base 22 having a drilling mast 24, a pipe handler 26, which is hereinafter also referred to as drill rod handling means, and a drill rod magazine 28, which is hereinafter also referred to as depositing means.

The present rig 20 can be either an offshore rig or an onshore rig. In the case of the offshore rig it is preferred that the base 22 is movable on rails with respect to a ground both in a longitudinal direction X and in a transverse direction Y. It is assumed hereinafter that by the longitudinal direction X a direction is understood into which also a connecting line between the center of the drill hole 30 adjacent to the drilling mast 24 and a center line of the drilling mast 24 extends. The transverse direction Y extends at right angles to the longitudinal direction X. The base 22 includes three floors which are preferably interconnected by stairs in the embodiment shown in FIG. 2. The present invention is not restricted to providing the base having three floors, however, but in response to the drilling requirements any number of floors can be provided. The base preferably is in the form of modules so that a stepwise erection of the base is possible.

In the base a blowout preventer not shown in FIG. 2 and a trip tank not shown in FIG. 2 can be provided. The base is provided on the drill hole to be made which is continued in the working platform 32 provided above the base in the drill hole 30. Furthermore a control cabin 34 and a crane 36 for handling objects are arranged on the working platform 32.

In the longitudinal direction X adjacent according to the above description concerning the drill hole 30 the preferred modular drilling mast 24 is provided having two interconnected drilling mast segments in the shown embodiment. At the drilling mast 24 in its longitudinal direction Z extending perpendicularly to the longitudinal direction X and to the transverse direction Y gear racks 38 and guide rails are arranged at which a feed carriage 40 is movable. At least one gearwheel is driven at the feed carriage 40 by at least one feed motor. Furthermore, at the feed carriage holding brakes are formed through which the feed carriage 40 can be fixedly arranged at the drilling mast 24.

The feed carriage further includes a top drive 42 having a receiving device for mounting a drill rod as well as a bar shaft 44 including a mounted elevator 46 for lifting drill rods. The elevator serves for quickly mounting and dismounting the drill rods with respect to the drill hole. During the drilling operation in which the torque is applied from the top drive 42 to the drill head provided in the drill hole, the elevator is pivoted away from a connecting line between the top drive and the drill hole 30. What is not shown in FIG. 2 is a screwing means via which drill rods can be screwed to each other at the drill hole. During screwing a drill rod already provided in the drill hole is held at the working platform by wedges which are not shown. For mounting the further drill rod, the further drill rod is arranged via the pipe handler 26 or the drill rod handling device 26 perpendicularly above the drill hole at the drill rod introduced to the same and is screwed to the drill rod provided in the drill hole by the screwing means.

The mounting of the drill rods is monitored via the control cabin 34. Apart from this monitoring in the control cabin, so far a plurality of monitoring and correcting operations from introducing the drill rod into the drill rod magazine 28 to screwing the drill rod with another drill rod provided in the drill hole 30 have been necessary. By the present invention, a plurality of measures are suggested for being able to minimize or completely dispense with these monitoring and correcting operations so that the operating personnel in the control cabin 34 can concentrate on the tasks in connection with drilling the drill hole and with removing drill rods from the same without a focus of activity being put on monitoring the drill rod transport.

In the following description different partial sections of automation of the drill rod transport are described. Said partial sections can be carried out in any combination.

Figure 3:
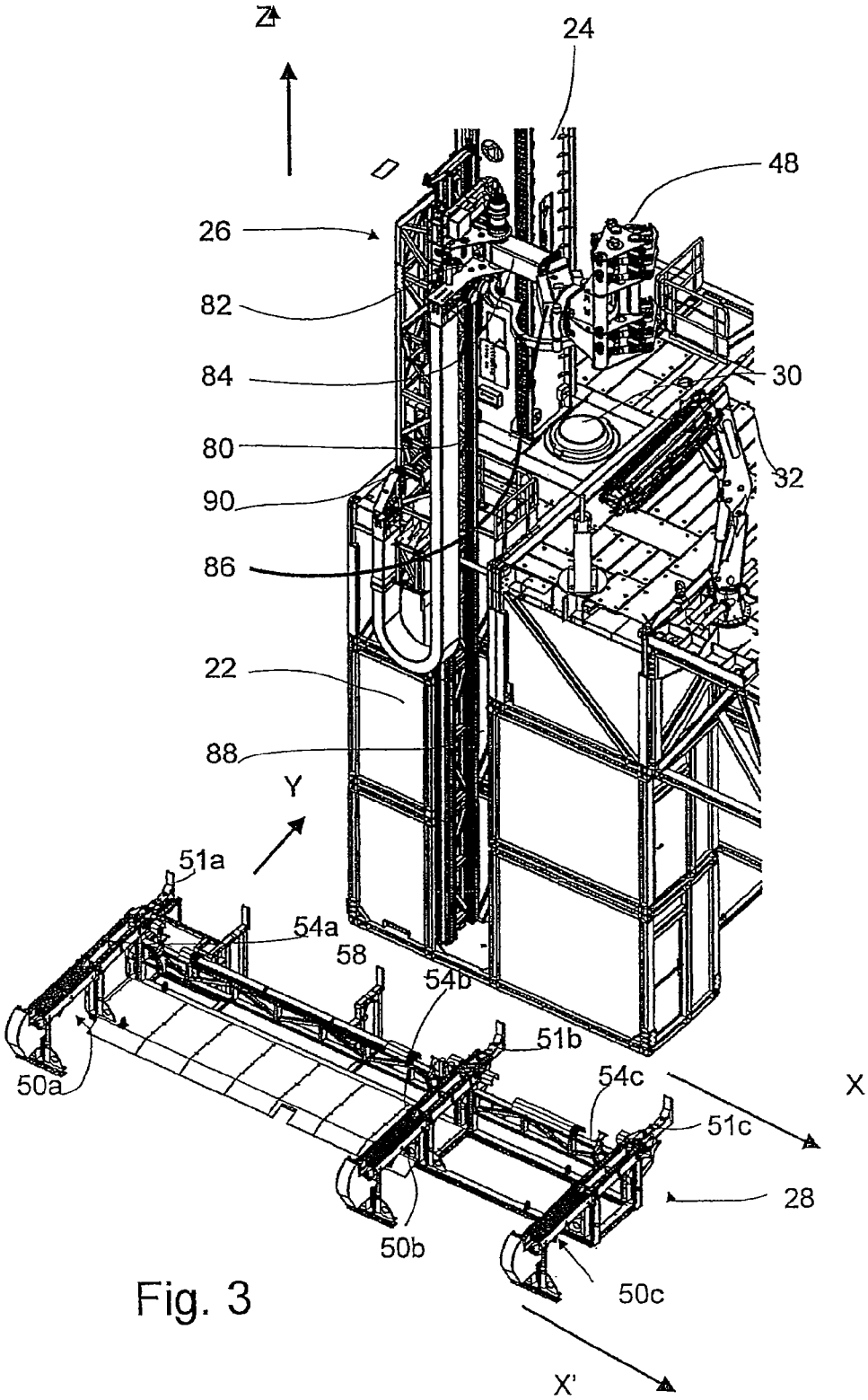
FIGS. 3 and 4 show cut-outs from FIG. 2, i.e. the depositing means including drill rod gripper and the drill rod gripper including an elevator.
Figure 4:
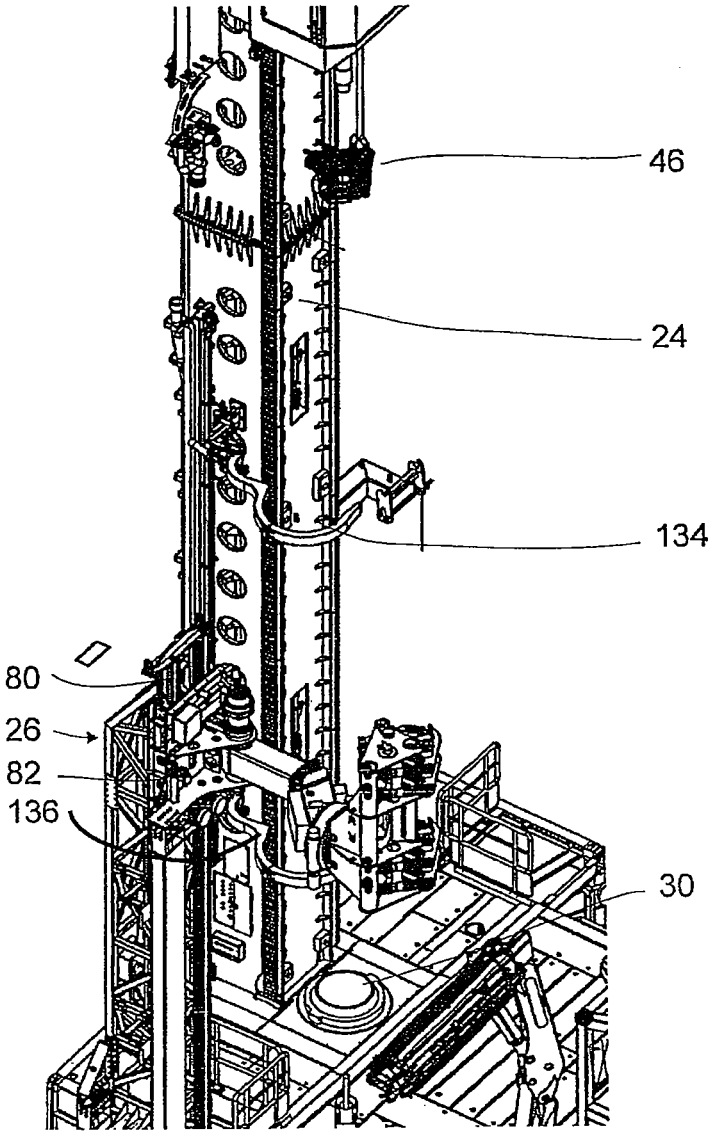

The following description also refers to the FIGS. 3 and 4, wherein FIG. 3 is an enlarged view of FIG. 2 in which the drill rod handling device 26 and the drill rod magazine 28 are represented. In FIG. 4 the drill rod handling device is shown enlarged together with the elevator 46 at the drill mast 24.

First Partial Section of the Drill Rod Transport

With reference to FIG. 3, the introduction of the drill rods to the drill rod magazine 28 is described in more detail. Preferably in the case of offshore rigs, a revolving crane is used for forming stacks of drill rods. From this drill rod stack the drill rods are then transported via another revolving crane, which is an embodiment of the transport means described in the following, from the stack to the drill rod magazine 28 in which the drill rods are deposited for being picked up by the drill rod handling device 26. During transport by the further crane different safety aspects have to be taken into consideration. First of all it has to be ensured that a release of the drill rods from the further crane may only be performed above the drill rod magazine 28 when the drill rod is deposited. Further care has to be taken that when transporting the drill rod by the further crane any damage of the rig or the environment thereof by the drill rod being moved has to be avoided. These options for increasing the safety are realized according to the invention by releasing the drill rods from the relative position of the drill rods in the space, especially with respect to the depositing means. It is one option that it is assumed with a detected relief of the second crane that the drill rod is provided on the drill rod magazine 28. After that, the further crane can then be opened so that the drill rod is made to be rest on the drill rod magazine.

Another option consists in the fact that at the drill rod magazine 28 a detecting means is provided the output signal of which causes release of the drill rod at the second crane. This further detecting means can be provided alternatively or in addition to the device for detecting the relief at the transport means. In addition or as an alternative thereto, a release of the drill rod from the second crane above the depositing means can only be effectuated when the holding means for the drill rod at the second crane is provided within a predetermined zone above the depositing means.

As an alternative or in addition thereto, for the movement of the drill rod by the second crane only a predetermined zone can be provided above the depositing means and toward the stack from which the drill rods are removed by the second crane. A movement of the drill rod out of this zone is prevented by a blocking of the corresponding translational or rotational movement of the second crane. By the latter measure the velocity of the drill rod transport from the stack to the drill rod magazine can be increased and at the same time great safety can be guaranteed.

Thus an increased safety can be reached by the first partial section of the drill rod transport compared to the drill rod transport by means of fork lift. Compared to the drill rod transport exclusively by manual operation of the second crane, the error rate can be strongly reduced in accordance with the present invention.

The present invention is not restricted to the fact that merely one drill rod at a time is taken to the depositing means by the second crane, but two or more rods can be transported by the second crane, if required.

Second Partial Section of the Drill Rod Transport

With reference to FIG. 3, now the second partial section of the drill rod transport is described. In this second partial section the drill rods taken to the drill rod magazine 28 are separated in such way that they can be gripped individually by a gripper 48 provided at the drill rod handling device 26 and can be disposed above the drill hole 30. For this purpose, it is preferred that the longitudinal extension X' of the drill rod magazine 28 extends in parallel to the longitudinal direction of the arrangement of the center of the drill hole 30 and the center of the drilling mast 24. In this way, the separated drill rod can be gripped from the drill rod magazine 28 by the gripper in direct vicinity to the base 22 from which the drill rod magazine 28 has a small distance and can be conveyed to the intended position with small space requirements.

According to the embodiment of FIG. 3, the drill rod magazine 28 includes three conveying means 50*a*, 50*b* and 50*c* each extending in the transverse direction Y and each having a transfer means in the form of a transfer groove 51*a*, 51*b*, 51*c* in FIG. 3 and a respective conveyor chain 54*a*, 54*b*, 54*c*. The conveying means 50*a*, 50*b*, 50*c* extend in parallel to each other and the transfer grooves 51*a*, 51*b*, 51*c* thereof are aligned with each other. As a result, drill rods applied to the conveyor chains 54*a*, 54*b*, 54*c* can be conveyed by the conveyor chains in the transverse direction Y. When detecting the drill rod on the conveyor chain 54*a*, 54*b*, 54*c* at a predetermined position adjacent to the transfer 51*a*, 51*b*, 51*c* a separating means is triggered, which may be a cylinder, for instance, so that the movement of an individual drill rod into the transfer groove 51*a*, 51*b*, 51*c* is permitted. The gripper 48 of the drill rod handling device is preferably arranged such that the gripper 48 can engage in a portion between two of the three conveying means 50*a*, 50*b*, 50*c* and can grip the drill rod. In the embodiment of FIG. 3 these are the conveyor means 50*a* and 50*b*. The gripper 48 holding the drill rod then rotates in such way that the drill rod moves into a vertical position in which the shorter end of the drill rod points downward. It is ensured in this way that a minimum lift for the gripper 48 is sufficient to position the drill rod above the drill hole 30 so that no further parts of the rig are contacted. Catches adapted to transport one drill rod or a particular number of drill rods on the conveyor chain to the transfer groove 51*a*, 51*b*, 51*c* are preferably arranged at the conveyor chain.

As an alternative to the use of a separating means at the conveying means it is possible that a drill rod is introduced into the transfer groove directly by the second crane or that predetermined departments, for instance predetermined chambers, are provided on the conveyor chain in which departments only one drill rod can be deposited at a time. In this manner, during further transport by the dimension of one chamber the drill rod can be safely introduced into the transfer groove 51*a*, 51*b*, 51*c*.

Figure 5:
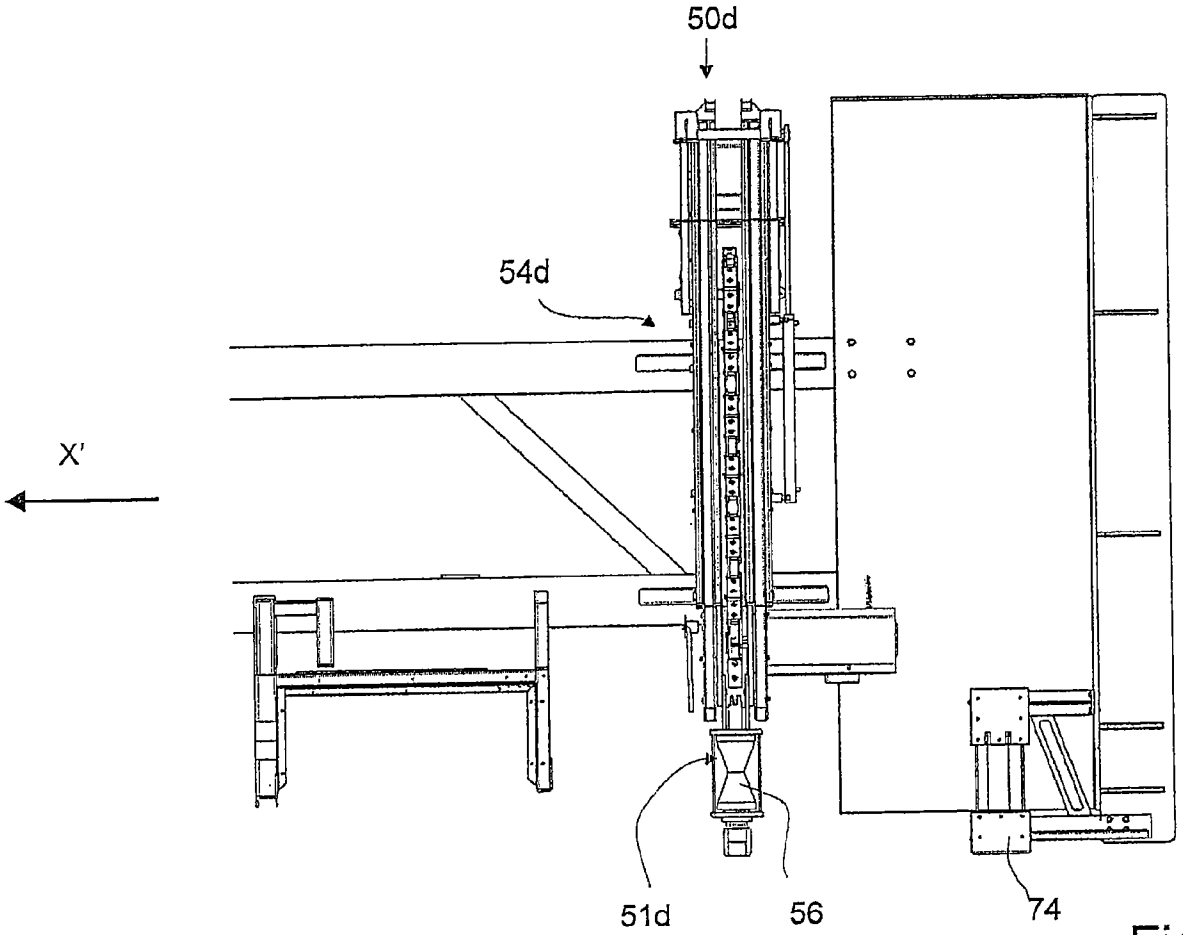
FIG. 5 shows a top view on a modification of the depositing means including light barrier and moving means for the drill rod.

The present invention is not restricted to a transfer groove 51*a*, 51*b*, 51*c*, but it can also be employed when using any transfer means. FIG. 5 discloses the top view on a conveying means 50*d* which can be used instead of the conveying means 50*a* in FIG. 3. The conveying means 50*b* and 50*c* are then formed in a correspondingly similar way. Apart from the conveyor chain 54*d*, the conveying means includes a conveying means 51*d* which is in the form of a roller. The roller is preferably formed by a double cone the smaller diameter portions of which are interconnected. Such roller-shaped transfer means 51*d* permits to position a drill rod on the same for being picked up by the gripper 48. At the same time, it is possible that when the roller 51*d* is driven by a motor 56 provided adjacent to the same the drill rod can be transported in the longitudinal direction X' and thus the drill rod can be aligned so that gripping by the gripper 48 at a defined position is facilitated.

The separation of the drill rods can be triggered, as an alternative to the lifting cylinder, for instance, equally by a respective forward movement of the conveyor chain. In this case, too, it is preferred that the position of the drill rod is detected before.

Third Partial Section of the Drill Rod Transport

Hereinafter, with reference to the FIGS. 3, 6 and 7 a first variant of the third partial section and with reference to the FIGS. 5 and 8 a second variant of the third partial section is described.

Figure 6:
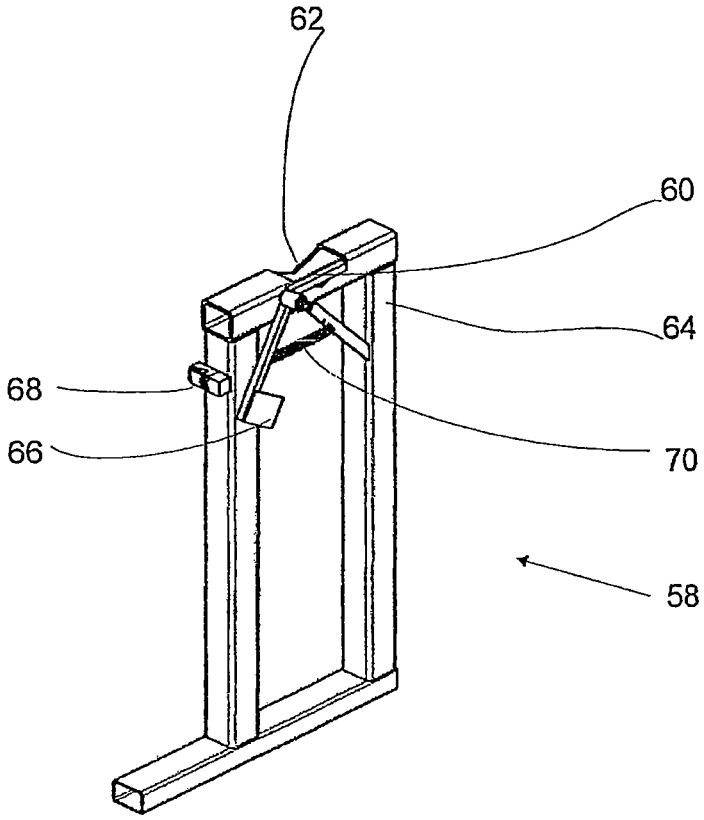
FIG. 6 shows a means for mechanically detecting the drill rod in the depositing means.
Figure 7:
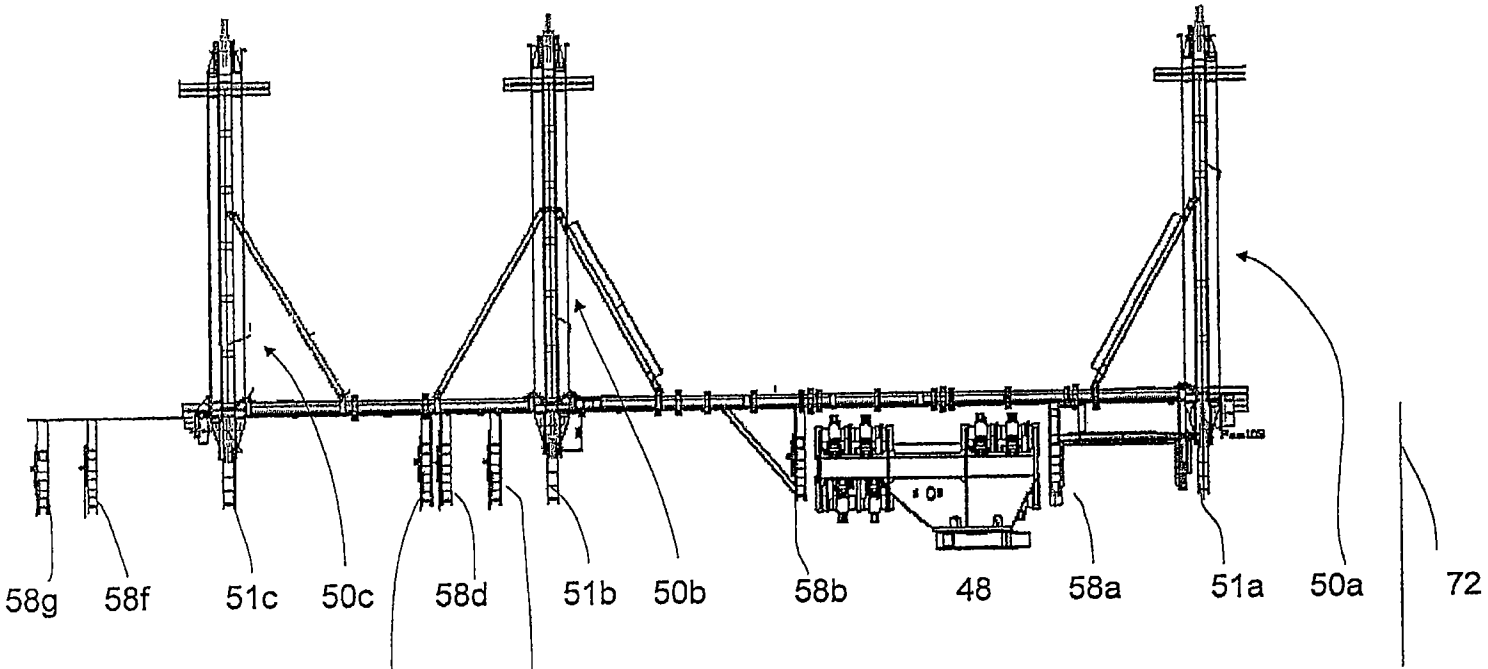
FIG. 7 shows a plurality of means for mechanically detecting the drill rod in the depositing means.

It is favorable to detect the presence of the drill rod in the transfer groove 51*a*, 51*b* and 51*c* in FIG. 3 by a detecting means 58 shown in FIG. 6 in a perspective view. The detecting means 58 includes an angular lever 60 that is forced downward by introducing a drill rod into a recess 62 in the support for the angular lever 60 in FIG. 6. A cam switch 66 is mounted at said angle lever 60 and is movable along with the same. When said cam switch 66 gets into the vicinity of a sensor 68 mounted to the support 66, said sensor 68 is triggered and transmits a signal to indicate the presence of the drill rod in the recess 62.

The angular lever 60 is biased by a spring 70 in such manner that it protrudes into the recess 62. Said detecting means 58 is not restricted to indicating the presence of a drill rod in the transfer groove, however. The top view of FIG. 7 illustrates a variant of the configuration of the drill rod magazine 28 of FIG. 3 in which a plurality of detecting means 58*a-g* are arranged both between the conveying means 50*a*, 50*b*, 50*c* and outside of the same. The distance of the detecting means 58*a-g* is defined by a stop 72 provided in FIG. 7 on the right. The two detecting means 58*g* and 58*f* provided outside the area between the conveying means 50*a*, 50*b* and 50*c* are provided in case that, for instance, the drill rod is too strongly malpositioned. In response to the length of the introduced drill rod, the respective detecting means 58*a-g* are triggered depending on the length of the drill rod. Due to the arrangement of the drill rod in the transfer groove 51*a*, 51*b*, 51*c*, either the gripper 48 can grip the drill rod at a position or the lift of the gripper 48 can be appropriately adjusted so that an adequate transfer to the elevator at the drilling mast can take place.

According to a modification it is possible to compare the values for the length of the drill rod established due to the signals at the detecting means 58*a-g* to a desired value for the drill rod. In the case of a predetermined deviation of the values, an error message can be produced. An error message can also be produced when signals are detected by proximity switches or detecting means which is not possible in the case of joint triggering when a continuous drill rod is introduced.

By virtue of such configuration the error susceptibility of the apparatus for handling rod-shaped components according to the invention can be reduced.

The present invention is not restricted to the use of detecting means 58 in accordance with FIG. 6, however. Any other mechanical release means can be used or a contact-free operation can be performed. Thus, instead of one or more detecting means 58, for instance light barriers can be used. In FIG. 5 a light barrier 74 is shown which triggers a detecting signal when a drill rod is placed on the transfer means 51*d*. The use of a light barrier 74 is advantageous especially in connection with the translational movement of a drill rod in the transfer means. When displacing the drill rod in the longitudinal direction X' thereof via actuation of the motor 56 in FIG. 5, for instance, the drill rod can be adjusted exactly at the position at which, for instance after detection of the drill rod by the light barrier, the drill rod has just left the light barrier. In this way a predetermined position of the drill rod can be provided in the drill rod magazine 28 and thus the pick-up by the gripper 48 can be permitted at a defined position.

As an alternative to the stationary arrangement of one or more light barriers 74, it is also possible to carry out a movement of the light barrier instead of moving the drill rod by a motor 56 in FIG. 5, for instance. In this manner, the drill rod remains in the same relative arrangement in the drill rod magazine, but its position in the drill rod magazine 28 can be predicted with accuracy so that an appropriate operation of the pick-up means and an exact arrangement of the drill rod above the drill hole 30 are permitted.

Figure 8:
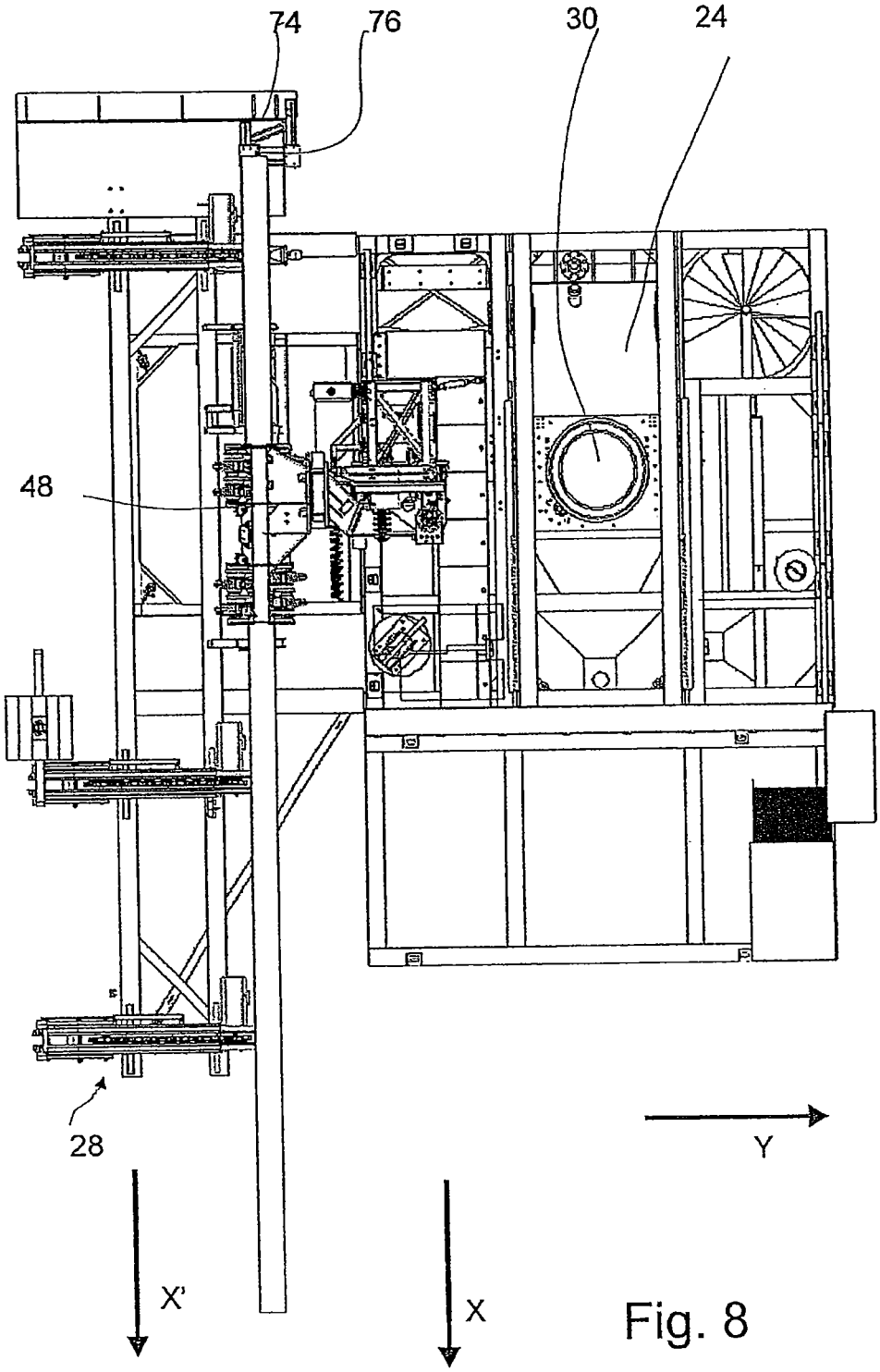
FIG. 8 shows a top view on the rig and the depositing means with a drill rod provided in the gripper.

In FIG. 8 a top view on a rig comprising the drill rod magazine 28 is shown in which a drill rod 76 is held by the gripper 48 in the longitudinal direction X above the drill rod magazine 28 and in which the light barrier 74 is illustrated. This top view reveals that due to the parallel arrangement of the longitudinal direction X of the rig and the longitudinal direction X' of the drill rod magazine a space-saving arrangement of the drill rod magazine 28 next to the base is possible and the gripper 48 can grip the drill rod 76 without moving into the transverse direction Q and can pivot toward the drill hole 30 within a small space required.

Fourth Partial Section of the Drill Rod Transport

With reference to FIG. 3, now the structure of the drill rod handling device 26 including the gripper 48 is described in detail. The drill rod handling device 26, hereinafter also referred to as pick-up means, includes a guide frame 80, a lift carriage 82, a pivot arm 84, a gripper rotating means 86 and the gripper 48. The guide frame 80 is disposed in a lateral recess 88 of the base 22 and preferably has a modular structure so that the guide frame 80 can be composed of several parts.

In its lower portion in which the guide frame is provided in the base it can be directly mounted to the base. In the area above the working platform 32 the guide frame 80 is mounted to a lattice mast 90. Along the guide frame both guide faces and, for instance, gear racks for moving the lift carriage at the guide frame in the direction Z are provided. The guide faces and the gear racks can also be arranged in a modular way. The pivot arm 84 is pivoting about the lift carriage 82 preferably by 180° or less. The gripper 48 is rotatable via the gripper rotating means 86. In this way it can be arranged, upon pivoting the pivot arm 84 to the left direction shown in FIG. 3, i.e. toward the drill rod magazine 28, at a position in which the longitudinal axis of the gripper extends in the direction of the longitudinal axis X' of the drill rod magazine 28. On the other hand, a movement of the pivot arm 84 away from the drill rod magazine 28 toward the drilling mast 24 allows arranging a drill rod gripper axially parallel to the drill hole 30 and in such fashion that the longitudinal axis of the gripper extends aligned toward the central axis of the top drive. In this way it is possible to dispose a drill rod from the drill rod magazine 28 merely by a pivoting movement and a rotational movement of the gripper above the drill hole 30.

It is preferred that the drill rod magazine 28 is adjacent to the base in such way that a change in length of the pivot arm 84 is not necessary to perform the described movement.

When operating the afore-described gripper, the safety and/or the degree of automation is increased by the present invention.

Figure 9A:
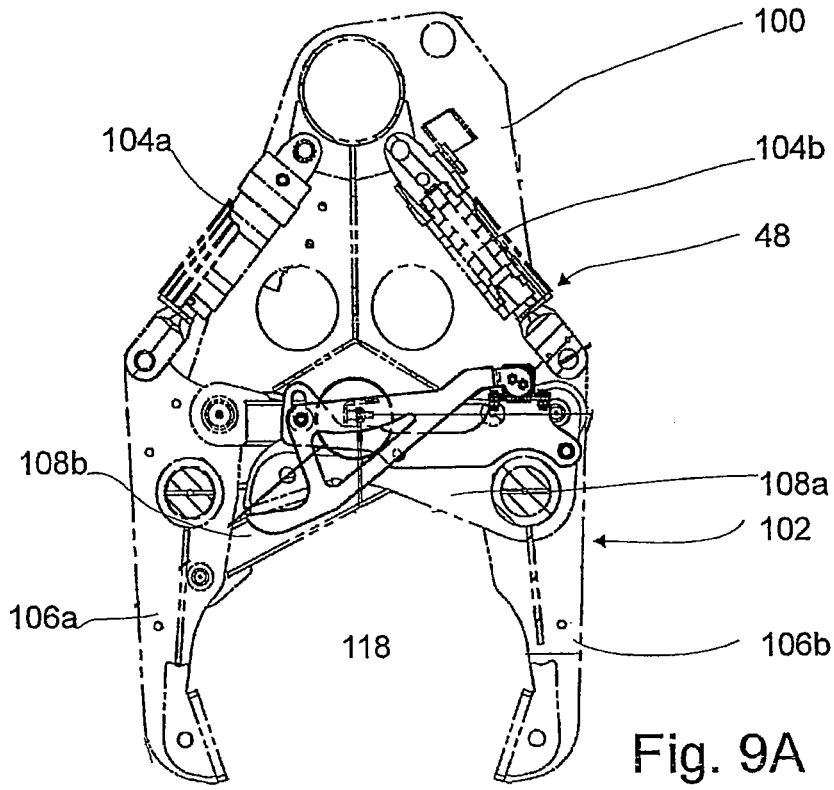
FIGS. 9A, 9B and 9C show a side view of a gripper, a front view as well as a top view of a lever arrangement for detecting the drill rod.
Figure 9B:
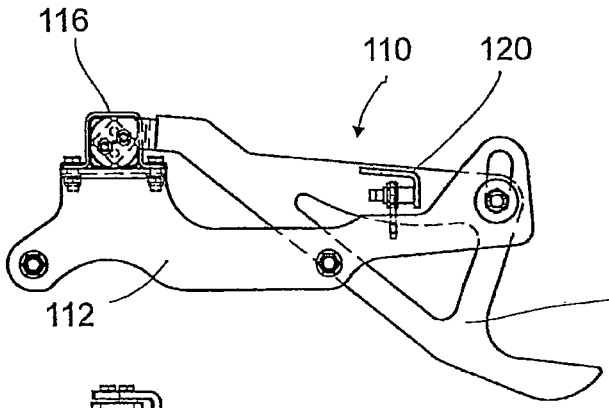
Figure 9C:
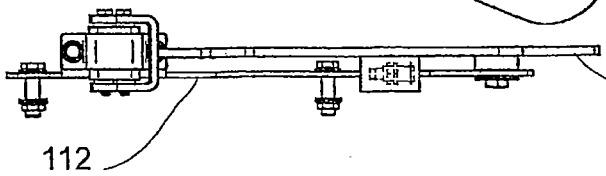

For this purpose the presence of the drill rod in the gripper is established with higher safety by the same before a transport movement. FIG. 9*a* shows a side view of the drill gripper 48 according to the invention in a plane perpendicular to the longitudinal axis of the gripper. FIG. 9*b* illustrates a lever mechanism for detecting the drill rod provided in the gripper in the front view and FIG. 9*c* shows the top view on the lever arrangement according to the invention for the gripper.

The gripper 48 substantially includes a gripper body 100 and a plurality, four in FIG. 3, of gripper arm arrangements 102 mounted to the same. These gripper arm arrangements 102 are operated via hydraulic cylinders 102*a*, 104*b* in accordance with FIG. 9A. Each gripper arm arrangement includes two pairs of gripper arms that are movable about the same angular amount controlled by the hydraulic cylinders 104, 104*b*. In FIG. 9A a pair of gripper arms 106*a*, 106*b* and a pair of gripper arms 108*a*, 108*b* are shown. In this open position of the gripper 48 shown in FIG. 9A the gripper arm 108*b* associated with the gripper arm 108*a* is not visible. When operating the pairs of gripper arms 106*a*, 106*b* and 108*a*, 108*b* they move toward a drill rod center which is independent of the diameter of the drill rod.

In order to detect that the drill rod is provided in the gripper 48, at the gripper arm 108*a* the lever arrangement 110 including an element 112 adapted to be fixedly mounted at the gripping part 108*a* and a lever 114 rotatably mounted to said element is provided. The lever 114 is biased at its pivot via a rubber spring element 116 toward the zone 118 between the gripper arms to introduce the drill rod. When moving the lever 114 with respect to the element 112 against the spring bias of the rubber spring element 116, a signal is triggered in a sensor 120 provided at the lever 114 and the element 112 to indicate the presence of the drill rod in the gripper 48. The present invention is not restricted to a rubber spring element 116 but any biasing means can be provided for the lever in the zone 118 between the gripper arms. The sensor 120 preferably is an inductive proximity switch.

It is preferred that the lever is provided at a pair of gripper arms 108*a*, 108*b* disposed adjacent to the beam 100 in order to avoid a wrong detection that might occur if it was provided at the outer pair of gripping arms 106*a*. 106*b*.

It is further preferred when the pressures in the hydraulic cylinders 104*a*, 104*b* are detected and a movement of the gripper 48 with respect to the guide frame 80 takes place only when both the presence of the drill rod in the gripper 48 is detected by the lever arrangement and the pressure for pressing the gripper arms is detected with a predetermined value. In this way it can be ensured that the drill rod is transported with sufficient holding force.

Fifth Partial Section of the Drill Rod Transport

Figure 10:
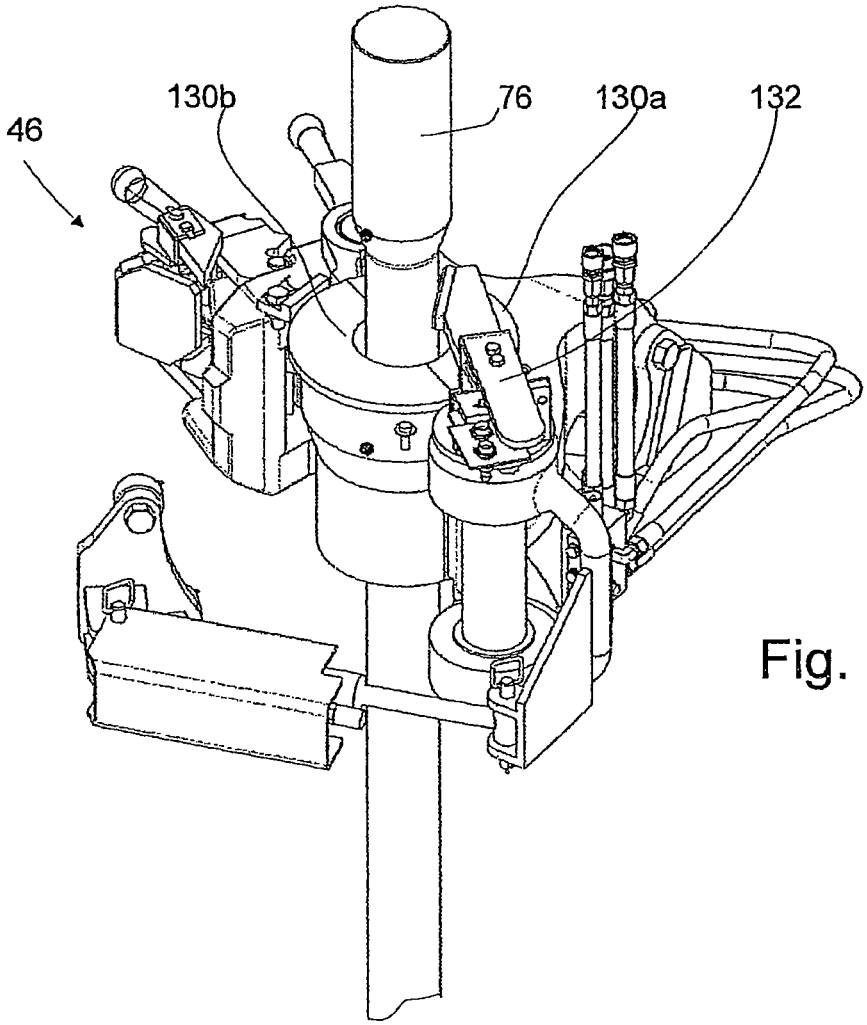
FIG. 10 shows a perspective view of an elevator including an associated detecting means.

In the fifth section of the drill rod transport the subject matter is constituted by a safe transfer between the drill rod handling apparatus 26 shown in FIG. 4 and the elevator 46 representing a lifting means for drill rods above the drill hole. FIG. 10 shows the elevator 46 including an introduced drill rod 76 in more detail. The elevator 46 comprises two half-shells 130*a*, 130*b* that are closed hydraulically for seizing the drill rod 76. In FIG. 10 a lever 132 biased toward the drill rod 76 is provided above the half-shells 130*a*, 130*b*. The bias can be produced, for instance, by a square biased in one direction by rubber elements.

Since the drill rod 76 is pivoted by the gripper 48 between the half-shells 130*a*, 130*b*, the lever has to be arranged in such way that it is forced back during a pivoting operation. With closed half-shells 130*a*, 130*b* a predetermined pressure builds up in the closing cylinders for the half-shells. This pressure can be measured and can be employed in addition to an operating signal produced by the lever 132 via proximity sensors, for instance, for detecting the drill rod 76 provided in the elevator. Moreover it is possible to provide at the elevator 46 a latch for the half-shells by which likewise a closing signal for the elevator can be produced in the closed state.

In addition or alternatively to the afore-mentioned method of detecting the drill rod in the elevator, it is possible to provide the lift carriage 82 in the guide frame 80 with a free wheel in FIG. 4 running free upward, i.e. in Z direction of the drilling mast. In such configuration the drill rod gripped by the gripper 48 can equally be gripped by the elevator 46 and the drill rod 76 can be lifted by the elevator by a predetermined distance. In case that via a movement sensor for detecting the movement of the lift carriage 82 with respect to the guide arm 80 an upward movement of the lift carriage is detected, it is assumed that the drill rod 76 is gripped by the elevator.

The afore-mentioned mechanical coupling between the elevator and the gripper ensures a tight gripping of the drill rod by the elevator with higher safety. In this way, the risk of a downward movement of the drill rod that has not been tightly gripped by the elevator can be prevented.

For reasons of an increased safety it is preferred, however, that safety brackets 134, 136 provided at the drilling mast are equally brought into the locked position with the drill rod being provided in the elevator so that, irrespective of the type of error, the drill rod can be prevented from dropping from the drilling mast.

Alternatively to the free wheel of the lift carriage at the guide frame, it is possible to allow the upward movement of the gripper in any other way, for instance by spring elasticity during movement.

It is further preferred for guaranteeing an accident-free operation of the rig that the position of the drill rod handling apparatus 26 and/or the gripper 48 is detected before pick-up of the drill rod at the drill rod magazine 26 or a release at the elevator 46 is permitted. This fact additionally increases the safety. The circuitry for the hydraulic supply of the drill rod handling apparatus can be designed in such way that in the area outside the defined zones for the release it is only possible to re-feed pressure in the closing direction, for instance for compensating for leakage, but not to open the gripper.

Sixth Partial Section of the Drill Rod Transport

In this partial section the drill rod is applied to be centered with respect to a screwing means above the drill hole 30. Furthermore, a secured removal of the wedges is to be permitted.

Figure 11A:
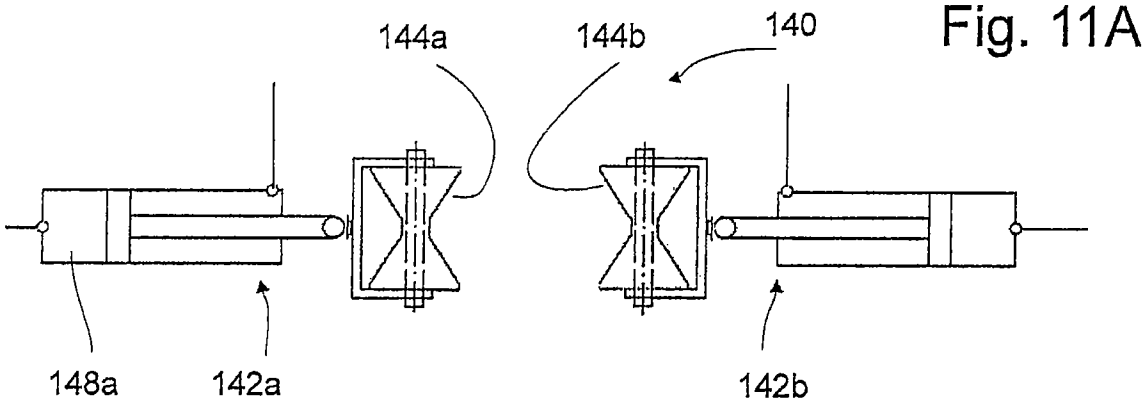
FIGS. 11A and 11B show centering rods and a detailed view of the same for centering the drill rod above the drill hole.
Figure 11B:
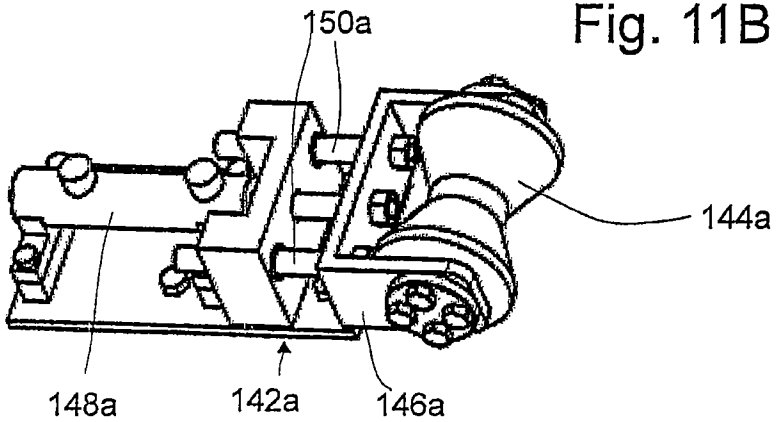

For this purpose, above the drill hole 30 and a screwing means, which is not shown, a rods centering means is provided which is schematically represented in the top view of FIG. 11*a*, the single element of which is shown in FIG. 11*b*.

Such rods centering means is to arrange a drill rod disposed off-center from the drill hole 30 centrally above the drill hole. The rods centering means 140 includes two centering elements 142*a*, 142*b* the centering element 142*a* of which is shown in the perspective view in FIG. 11*b*. The centering element 142*a* includes a guide element 144*a* that is rotatably supported in a fork 146*a* and preferably is in the form of a double cone including a groove between the small diameters of the cone. The centering element 142*b* includes a guide element 144*b* that is rotatably supported in a fork 146*b* and preferably is in the form of a double cone including a groove between the small diameters of the cone. The fork 146*a* is operated by a hydraulic cylinder 148*a* and is kept constant in its alignment by two guide bars 150*a*. Two of these centering elements 142*a*, 142*b* are opposed to each other and are hydraulically pressurized along synchronous paths toward each other. In this way, the drill rod is forcedly guided over the drill hole 30. The rods centering 140 is employed after the drill rod has been detected in the elevator 46 and before it is screwed to another drill rod provided in the drill hole 30.

By the configuration of the rods centering according to the invention, the previously common manual centering of the drill rod above the drill hole is dispensed with.

After centering the drill rod above the drill rod provided in the drill hole 30, it is necessary to safely lower the drill rod introduced last by the drill rod handling apparatus 26.

Subsequently the introduced drill rod is screwed to the drill rod provided in the drill hole 30. After that, an upward movement of the top drive with the drill rod is effectuated. Then the wedges by which the pipeline provided in the drill hole 30 is wedged are removed and a detecting means detects that the wedges have been removed. Only after this detecting signal the drill rod introduced last by the drill rod handling apparatus 26 is lowered into the drill hole. During such lowering the force can be detected so as to detect wedges still provided in the drill hole. In the case of detecting such obstacle, an emergency shut-down of the top drive can be effectuated.

The present invention comprising the afore-mentioned partial sections is not restricted to introducing a drill rod to a drill hole but can also be carried out inversely, with the detecting procedure being reversed. In order to be able to better compare the mounting operation and the dismounting operation, hereinafter the mounting and dismounting processes are described.

First the mounting is described. After detecting the length of the drill rod in the drill rod magazine, the drill rod is picked up by the drill rod handling apparatus. When the provided drill rod is detected in the drill rod handling apparatus, and optionally the corresponding hydraulic pressure is applied, the drill rod handling apparatus is moved into the waiting position. Upon a respective mounting signal the drill rod handling apparatus then pivots into the transfer position while the top drive adopts the takeover position. The elevator is swiveled in and closed. The signal "elevator closed" is produced in response to the afore-mentioned sensor signals and the drill rod is detected in the elevator. When the drill rod is detected in the elevator, the top drive is moving upward. When the drill rod handling apparatus is moving as well, this movement is detected and the top drive is decelerated, whereupon the gripper of the drill rod handling apparatus is opened. After that, the gripper of the drill rod handling apparatus pivots to the drill rod magazine for picking up a new rod.

For introducing the drill rod first of all the top drive is pulled upward and the wedges above the drill hole are opened. Upon the opening signal for the wedges the top drive is moved downward and the rods are suspended again in the wedges. Subsequently, the elevator is opened and the open state of the elevator is fixed, which is followed by pivoting of the elevator and, when the elevator is pivoted out, by a movement of the top drive upward into the waiting position. After that, the further mounting of the rods is possible.

When the drill rod is provided in the elevator, the latter moves upward for relieving the wedges, the wedges are opened, the top drive moves upward by a rods length. The pipeline is suspended in the wedges. Then the pipeline is unscrewed. After that the gripper pivots in.

The grippers of the drill rod handling apparatus are closed and when the drill rod is detected in the drill rod handling apparatus the elevator is opened and pivoted away. When the elevator is pivoted out, the top drive is pulled upward, the gripper is pivoted out and the rod is deposited in the drill rod magazine. When a signal is produced that no drill rod is provided in the gripper and the rod is provided in the drill rod magazine, the drill rod gripper is guided to the waiting position and the top drive is moved downward into the pick-up position to prepare the dismounting of further rods.

In accordance with the invention, another apparatus and another method of handling rod-shaped components can be provided. This apparatus and this method relate to the dismounting of the drill rods and to providing the drill rods with caps.

In order to avoid leakage of drilling fluid from the drill rod the drill rod handling apparatus can be provided, for instance, adjacent to the gripper including a drilling fluid pick-up means, for instance in the form of a trough-like element. Such trough-like element allows the leakage of drilling fluid from the drill rod when dismounting the latter and prevents the working platform 32 and the environment from being soiled by the drilling fluid.

In accordance with a further development of the invention, at the drill rod magazine a means is provided for providing either one side or both sides of the drill rods introduced to the drill rod magazine with protective caps. It is possible in this manner to avoid manual work of the operating personnel.

Thus the present invention relates to an apparatus and a method of handling rod-shaped components at a rig. By modifications of the apparatus and the method the degree of automation and the safety are increased, inter alia, by the fact that rod-shaped components are deposited on a depositing means at defined positions and under defined conditions, separation of the rod-shaped components on the depositing means is monitored, secure holding at a gripper is checked and the completed transfer to an elevator is confirmed.

Hereinafter preferred aspects of the present invention are described.

In accordance with a 1$^{st}$ aspect there is provided an apparatus for handling rod-shaped components at a rig (20), comprising:

a depositing means (28) for rod-shaped components in which rod-shaped components (76) can be deposited, preferably substantially in parallel to a connecting line between the center of the drill hole (30) and the center of the drill mast (24), a lifting means including a lift carriage (82), a guide means (80) for guiding the lift carriage (82) and a drive for displacing the lift carriage (82), a pick-up means (48) attached to the lift carriage (82) for picking up a rod-shaped component (76) from the depositing means (28), wherein the pick-up means (48) is pivoting with respect to the lift carriage (82) at a plane perpendicular to the displacing direction (Z) of the lift carriage (82) such that a rod-shaped component (76) can be arranged above a drill hole (30).

In accordance with a $2^{nd}$ aspect there is provided an apparatus for handling rod-shaped components at a rig (20), preferably according to aspect 1, comprising a transport means for the rod-shaped components from an intermediate depositing means to a depositing means (28) for rod-shaped components from which one rod-shaped component or plural rod-shaped components can be picked up at a time by a pick-up means (48), and a control means for the transport means by which the transport means is controllable in such manner that the rod-shaped component or components are released at the depositing means (28) in response to a position of the transport means relative to the depositing means (28).

In accordance with a $3^{rd}$ aspect there is provided an apparatus according to aspect 2, comprising a detecting means for detecting preferably the relief at the transport means for application to the depositing means.

In accordance with a $4^{th}$ aspect there is provided an apparatus according to aspect 2 or 3, comprising a detecting means at the depositing means for application to the depositing means.

In accordance with a $5^{th}$ aspect there is provided an apparatus according to any one of the aspects 2 to 4, wherein the control means permits the release of the rod-shaped component or components in response to a predetermined position relative to the depositing means.

In accordance with a $6^{th}$ aspect there is provided an apparatus according to any one of the aspects 2 to 5, comprising a detecting means for the position of the rod-shaped component or components at the transport means relative to the depositing means and, in response to an output signal of the detecting means for the relative position, the control means permits a movement of the rod-shaped component or components at the transport means within a predetermined zone only.

In accordance with a $7^{th}$ aspect there is provided an apparatus according to aspect 6, wherein the detecting means for the relative position includes at least position sensors at the transport means.

In accordance with an $8^{th}$ aspect there is provided an apparatus according to any one of the aspects 2 to 7, wherein the transport means is a crane.

In accordance with a $9^{th}$ aspect there is provided an apparatus for handling rod-shaped components at a rig (20), preferably according to aspect 1 and/or 2, comprising a depositing means (28) for rod-shaped components including at least a transfer means (51*a*, 51*b*, 51*c*; 51*d*) for a separate removal of the rod-shaped component (76) by a pick-up means (48) into which a rod-shaped component a) either can be introduced by a transport means for the transport of the rod-shaped components (76) to the depositing means (28), b) or can be introduced by a separating means provided at the depositing means (28) in response to a detecting signal for the position of the rod-shaped component (76) at the depositing means (28).

In accordance with a $10^{th}$ aspect there is provided an apparatus according to aspect 9, wherein the transfer means is a transfer groove (51*a*, 51*b*, 51*c*).

In accordance with an $11^{th}$ aspect there is provided an apparatus according to aspect 9 or 10, wherein the separating means includes a one-stroke cylinder, preferably a lifting cylinder.

In accordance with a $12^{th}$ aspect there is provided an apparatus according to any one of the aspects 9 to 11, wherein the depositing means has at least one conveying means (54*a*, 54*b*, 54*c*; 54*d*) including at least one catch disposed at a conveyor chain by which a rod-shaped component (76) can be transported to the position of the pick-up by the pick-up means (48).

In accordance with a $13^{th}$ aspect there is provided an apparatus according to any one of the aspects 9 to 12, wherein the depositing means includes at least one conveying means by which at least two rod-shaped components can be transported to the transfer means.

In accordance with a $14^{th}$ aspect there is provided an apparatus according to aspect 13, wherein the depositing means comprises a plurality of conveying means.

In accordance with a $15^{th}$ aspect there is provided an apparatus according to aspect 14, wherein the depositing means comprises three conveying means and the depositing means is disposed with respect to the pick-up means such that the rod-shaped component can be removed by the pick-up means between two conveying means of the depositing means.

In accordance with a $16^{th}$ aspect there is provided an apparatus for handling rod-shaped components at a rig, preferably according to aspect 1 and/or 2 and/or 9, comprising a depositing means (28) having a means (58) for measuring the length of the rod-shaped component (76), wherein the length measuring means (58)

a) either includes at least two mechanical detecting means (58*a*, 58*b*) by which the respective introduced rod-shaped component (76) and the position thereof relative to the depositing means (28) are detectable, b) or includes a detecting means (74) for contact-free detection of the rod-shaped component (76) at a predetermined position.

In accordance with a $17^{th}$ aspect there is provided an apparatus according to aspect 16, wherein each of the mechanical detecting means includes a lever (60) biased into an introducing recess for a rod-shaped component by movement of which a detecting signal can be triggered when a rod-shaped component is introduced.

In accordance with an $18^{th}$ aspect there is provided an apparatus according to aspect 16 or 17, wherein at least two detecting means for contact-free detection are provided by which the end portions located opposed in the longitudinal direction of the rod-shaped component can be detected by the same.

In accordance with a $19^{th}$ aspect there is provided an apparatus according to aspect 18, wherein the detecting means for contact-free detection includes a light barrier.

In accordance with a $20^{th}$ aspect there is provided an apparatus according to any one of the aspects 16 to 19, wherein the length measuring means comprises, apart from the detecting means for contact-free detection, a moving means for moving the rod-shaped component introduced to the depositing means in its longitudinal direction or the length measuring means.

In accordance with a $21^{st}$ aspect there is provided an apparatus according to aspect 20, wherein the length measuring means further includes a control means by which the moving means can be controlled so that the rod-shaped component is arranged in the depositing means so as to be gripped by a pick-up means at a defined position.

In accordance with a 22$^{nd}$ aspect there is provided an apparatus for handling rod-shaped components at a rig, preferably according to one or more of the aspects 1, 2, 9 and 16, comprising a pick-up means (48) by which the rod-shaped component can be picked up by plural, preferably two, pairs of gripper arms (106*a*, 106*b*; 108*a*) and which includes a detecting lever (114) for the rod-shaped component in the pick-up means whose pivot is stationary with respect to a gripper arm (108*a*).

In accordance with a 23$^{rd}$ aspect there is provided an apparatus according to aspect 22, wherein the lever (114) is biased toward the zone defined between the gripper arms.

In accordance with a 24$^{th}$ aspect there is provided an apparatus according to aspect 22 or 23, comprising a control means allowing a movement of the pick-up means only when a rod-shaped component is detected in the pick-up means.

In accordance with a 25$^{th}$ aspect there is provided an apparatus according to any one of the aspects 22 to 24, comprising a pressure detecting means for the hydraulic closing pressure for closing the gripper arms at the pick-up means, wherein the control means allows a movement of the pick-up means only when a rod-shaped component is detected in the pick-up means and when a predetermined closing pressure is detected.

In accordance with a 26$^{th}$ aspect there is provided an apparatus according to any one of the aspects 22 to 25, wherein a gripper arm or plural gripper arms having a detecting lever is/are arranged preferably opposed to the pick-up opening for the rod-shaped component.

In accordance with a 27$^{th}$ aspect there is provided an apparatus according to aspect 26, wherein the gripper arms of each pair of gripper arms are mechanically connected such that they are only movable about the same respective angle.

In accordance with a 28$^{th}$ aspect there is provided an apparatus for handling rod-shaped components at a rig (20), preferably according to one or more of the aspects 1, 2, 9, 16 and 22, comprising a detecting means (132) for the rod-shaped component at a lifting means (46) arranged above the drill hole (30).

In accordance with a 29$^{th}$ aspect there is provided an apparatus according to aspect 28, wherein the detecting means includes a mechanical lever (132) attached to the lifting means and pivoting in a plane perpendicular to the lifting direction which triggers a detecting means for the presence of the rod-shaped component in the lifting means.

In accordance with a 30$^{th}$ aspect there is provided an apparatus according to aspect 28 or 29, wherein the detecting means includes a sensor for the hydraulic pressure to ensure the closed state of the lifting means (130*a*, 130*b*).

In accordance with a 31$^{st}$ aspect there is provided an apparatus according to any one of the aspects 28 to 30, wherein the detecting means includes a switch for detecting the closed lifting means for the rod-shaped component.

In accordance with a 32$^{nd}$ aspect there is provided an apparatus according to any one of the aspects 28 to 31, comprising a pick-up means (48) for the rod-shaped component by which the rod-shaped component (76) can be transferred to the lifting means and which is movable upward by the lifting means (46), and comprising a control means allowing a movement of the lifting means (46) with the rod-shaped component independent of the pick-up means (48) only after the pick-up means has been lifted above the rod-shaped component by the lifting means (46).

In accordance with a 33$^{rd}$ aspect there is provided an apparatus for handling rod-shaped components at a rig, preferably according to one or more of the aspects 1, 2, 9, 16, 22 and 28, comprising a detecting means for the position of the pick-up means (48) and a control means permitting an opening of the pick-up means (48) when a rod-shaped component (76) is introduced only above the depositing means (28) and adjacent to a lifting means (46) above the drill hole and preferably additionally with closed safety brackets adjacent to the transfer means.

In accordance with a 34$^{th}$ aspect there is provided an apparatus according to aspect 33, wherein the control means permits, preferably in an area outside the positions above the depositing means and in an area adjacent to a lifting means above the drill hole, that a hydraulic pressure for holding the rod-shaped component at the pick-up means is maintained.

In accordance with a 35$^{th}$ aspect there is provided an apparatus for handling rod-shaped components at a rig, preferably according to one or more of the aspects 1, 2, 9, 16, 22, 28 and 33, comprising two guide elements (144*a*, 144*b*) for the rod-shaped component (76) preferably in the form of a double cone by which the rod-shaped component (76) provided at a lifting means (46) above the drill hole (30) can be centered with respect to a rod-shaped component provided in the drill hole.

In accordance with a 36$^{th}$ aspect there is provided an apparatus according to aspect 35, wherein the guide elements are movable toward each other along synchronous paths, preferably via hydraulic cylinders (148*a*, 148*b*).

In accordance with a 37$^{th}$ aspect there is provided an apparatus for handling rod-shaped components at a rig, preferably according to one or more of the aspects 1, 2, 9, 16, 22, 28, 33 and 35 comprising a lifting means provided above the drill hole, and a control means by which the lifting means is controllable so that after an upward movement of the lifting means with rod-shaped components provided in the drill hole securing wedges are removable, the removal of the wedges is confirmed and the rod-shaped components are further lowered into the drill hole or the rod-shaped components are further lifted out of the drill hole.

In accordance with a 38$^{th}$ aspect there is provided an apparatus for handling rod-shaped components at a rig according to aspect 1, preferably according to one or more of the aspects 1, 2, 9, 16, 22, 28, 33 and 35, comprising a collecting device for liquid associated with the pick-up means which can be arranged in such fashion with respect to the pick-up means that liquid from the rod-shaped component can be collected in said collecting device during transport and/or support of the rod-shaped component by the pick-up means.

In accordance with a 39$^{th}$ aspect there is provided an apparatus according to aspect 38, wherein the collecting device is arranged at the pick-up means in a fold-away manner.

In accordance with a 40$^{th}$ aspect there is provided an apparatus for handling rod-shaped components at a rig according to aspect 1, preferably according to one or more of the aspects 1, 2, 9, 16, 22, 28, 33, 35 and 38, comprising at least one end cap applying means associated with the depositing means for rod-shaped components for applying an end cap to a rod-shaped component.

In accordance with a 41$^{st}$ aspect there is provided an apparatus according to aspect 40, wherein two end cap applying means are provided at opposed end portions of the depositing means by which end caps can be applied, preferably screwed, onto a rod-shaped component introduced to the depositing means.

In accordance with a 42$^{nd}$ aspect there is provided a method of handling rod-shaped components at a rig, comprising the steps of depositing at least one rod-shaped component in a depositing means, preferably substantially parallel to a connecting line between the drill hole center and the center of the drilling mast, picking up a rod-shaped component from the depositing means by a pick-up means preferably mounted at a lift carriage, wherein it is preferred when the lift carriage forms a lifting means with a guide means for guiding the lift carriage and a drive for displacing the lift carriage, and pivoting the pick-up means with respect to the lift carriage in a plane perpendicular to the displacing direction of the lift carriage such that a rod-shaped component can be arranged above a drill hole.

In accordance with a 43$^{rd}$ aspect there is provided a method of handling rod-shaped components at a rig, preferably according to aspect 42 comprising the steps of transporting the rod-shaped components or the rod-shaped component by a transport means from an intermediate depositing means to a depositing means for rod-shaped components, picking up a rod-shaped component at a time by a pick-up means, and controlling the transport means by a control means in such manner that a rod-shaped component is released at the depositing means in response to a position of the transport means relative to the depositing means.

In accordance with a 44$^{th}$ aspect there is provided a method according to aspect 43, wherein prior to the control step the step of detecting the load relief at the transport means for application to the depositing means is carried out by a detecting means.

In accordance with a 45$^{th}$ aspect there is provided a method according to aspect 43 or 44, wherein prior to the control step the step of detecting the application to the depositing means is carried out by a detecting means at the depositing means.

In accordance with a 46$^{th}$ aspect there is provided a method according to any one of the aspects 43 to 45, wherein in the control step the release of the rod-shaped component or rod-shaped components is allowed in response to a predetermined position relative to the depositing means.

In accordance with a 47$^{th}$ aspect there is provided a method according to any one of the aspects 43 to 46, wherein prior to the control step the step of detecting the position of the rod-shaped component or rod-shaped components at the transport means relative to the depositing means is carried out by a detecting means and in the control step in response to an output signal of the detecting means for the relative position a movement of the rod-shaped component at the transport means is allowed within a predetermined zone only.

In accordance with an 48$^{th}$ aspect there is provided a method according to aspect 47, wherein in the detecting step the relative position is detected by a position sensor at the transport means.

In accordance with a 49$^{th}$ aspect there is provided a method of handling rod-shaped components at a rig, preferably according to one or more of the aspects 42 and 43, comprising the step of a) introducing a rod-shaped component into a transfer means for the individual removal of the rod-shaped component by a pick-up means by a transport means for the transport of the rod-shaped components to a depositing means for rod-shaped components, or b) introducing a rod-shaped component into a transfer means for the individual removal of the rod-shaped component by a pick-up means by a separating means provided at the depositing means in response to a detecting signal for the position of the rod-shaped component at the depositing means.

In accordance with a 50$^{th}$ aspect there is provided a method according to aspect 49, wherein prior to the introducing step a respective rod-shaped component is transported to the position of pick-up by the pick-up means via at least one catch arranged at a conveyor chain.

In accordance with a 51$^{st}$ aspect there is provided a method according to aspect 49 or 50, wherein prior to the introducing step at least two rod-shaped components are transported to the transfer means via at least one conveying means of the depositing means.

In accordance with a 52$^{nd}$ aspect there is provided a method according to aspect 51, wherein the transport is effectuated via a plurality of conveying means.

In accordance with a 53$^{rd}$ aspect there is provided a method according to aspect 52, wherein the transport is effectuated via three conveying means of the depositing means and after the introducing step the step of removing the rod-shaped component is carried out by the pick-up means between two conveying means of the depositing means.

In accordance with a 54$^{th}$ aspect there is provided a method of handling rod-shaped components at a rig, preferably according to one or more of the aspects 42, 43, 49 and 54, comprising the step of length measurement at the rod-shaped component in a depositing means in which a) either the respective introduced rod-shaped component is detected by at least two mechanical detecting means, b) or the rod-shaped component is detected contact-free at a predetermined position by a detecting means.

In accordance with a 55$^{th}$ aspect there is provided a method according to aspect 54, wherein in the detecting step a detecting signal can be triggered by the movement of a lever as mechanical detecting means when a rod-shaped component is introduced, the lever being biased into an introducing recess for a rod-shaped component.

In accordance with a 56$^{th}$ aspect there is provided a method according to aspect 54, wherein in the step of detecting end portions of the rod-shaped component located opposed to the longitudinal direction thereof are detected contact-free by at least two detecting means.

In accordance with a 57$^{th}$ aspect there is provided a method according to aspect 54, wherein the contact-free detection is performed through light by means of a light barrier.

In accordance with a 58$^{th}$ aspect there is provided a method according to any one of the aspects 54 to 57, comprising the additional step of moving the rod-shaped component introduced to the depositing means in its longitudinal direction or a length measuring means by a moving means.

In accordance with a 59$^{th}$ aspect there is provided a method according to aspect 58, comprising the step of controlling the moving means by a control means so that the rod-shaped component is arranged in the depositing means so as to be gripped at a defined position.

In accordance with a 60$^{th}$ aspect there is provided a method of handling rod-shaped components at a rig, preferably according to one or more of the aspects 42, 43, 49 and 54, comprising the step of picking up the rod-shaped component by plural, preferably two, pairs of gripper arms of a pick-up means, and detecting the rod-shaped component in the pick-up means via a detecting lever the pivot of which is stationary with respect to a gripper arm.

In accordance with a 61$^{st}$ aspect there is provided a method according to aspect 60, comprising the step of biasing the lever within the zone defined between the gripper arms prior to the pick-up step.

In accordance with a 62$^{nd}$ aspect there is provided a method according to aspect 60 or 61, comprising the step of permitting a movement of the pick-up means only when a rod-shaped component is detected in the pick-up means.

In accordance with a 63$^{rd}$ aspect there is provided a method according to aspect 60, 61 or 62 comprising the step of permitting a movement of the pick-up means only when a rod-shaped component is detected in the pick-up means and with a predetermined hydraulic closing pressure detected by a pressure detecting means for closing the gripper arms at the pick-up means.

In accordance with a 64$^{th}$ aspect there is provided a method of handling rod-shaped components at a rig, preferably according to one or more of the aspects 42, 43, 49, 54, 60 and 64, comprising the step of detecting the rod-shaped component by a detecting means at a lifting means arranged above the drill hole.

In accordance with a 65$^{th}$ aspect there is provided a method according to aspect 64, wherein in the step of detecting the movement of a mechanical lever mounted at the lifting means and pivoting in a plane perpendicular to the lifting direction is detected and a detecting means is triggered by the lever for the presence of the rod-shaped component in the lifting means.

In accordance with a 66$^{th}$ aspect there is provided a method according to aspect 64 or 65, wherein in the step of detecting the hydraulic pressure for holding the rod-shaped component at the lifting means is detected.

In accordance with a 67$^{th}$ aspect there is provided a method according to aspect 64, 65 or 66, wherein in the step of detecting the switching state of a switch for detecting the closed holding means for the rod-shaped component at the lifting means is detected.

In accordance with a 68$^{th}$ aspect there is provided a method according to any one of the aspects 64 to 67, comprising the steps of transferring the rod-shaped component by a pick-up means to a lifting means and moving the lifting means upward and permitting a movement of the lifting means with the rod-shaped component independent of the pick-up means only after the pick-up means has been lifted above the rod-shaped component by the lifting means.

In accordance with a 69$^{th}$ aspect there is provided a method of handling rod-shaped components at a rig, preferably according to one or more of the aspects 42, 43, 49, 54, 60 and 64 comprising the steps of detecting the position of the pick-up means by a detecting means and allowing to open the pick-up means with an introduced rod-shaped component only above the depositing means and adjacent to a lifting means above the drill hole and preferably additionally with closed safety brackets adjacent to the transfer means by a control means.

In accordance with a 70$^{th}$ aspect there is provided a method according to aspect 69, comprising the step of permitting by the control means, preferably in an area outside the positions above the depositing means and in an area adjacent to a lifting means above the drill hole, that a hydraulic pressure for holding the rod-shaped component at the pick-up means is increased.

In accordance with a 71$^{st}$ aspect there is provided a method of handling rod-shaped components at a rig, preferably according to one or more of the aspects 42, 43, 49, 54, 60, 64 and 69, comprising the step of centering the rod-shaped component provided at a lifting means above the drill hole with respect to a rod-shaped component provided in the drill hole via two guide rollers preferably in the form of a double cone for the rod-shaped component.

In accordance with a 72$^{nd}$ aspect there is provided a method according to aspect 71, wherein during the centering step the guide rollers are movable toward each other with the same hydraulic pressure.

In accordance with a 73$^{rd}$ aspect there is provided a method of handling rod-shaped components at a rig, preferably according to one or more of the aspects 42, 43, 49, 54, 60, 64, 69 and 71, comprising the step of controlling a lifting means provided above the drill hole via a control means so that after an upward movement of the lifting means with rod-shaped components provided in the drill hole securing wedges can be removed, the removal of the wedges is confirmed and the rod-shaped components are further lowered into the drill hole.

In accordance with a 74$^{th}$ aspect there is provided a method of handling rod-shaped components at a rig, preferably according to one or more of the aspects 42, 43, 49, 54, 60, 64, 69 and 71, comprising the step of arranging a collecting device for liquids associated with the pick-up means with respect to the pick-up means in such manner that during transport and/or support of the rod-shaped component by the pick-up means liquid from the rod-shaped component can be collected in said collecting means.

In accordance with a 75$^{th}$ aspect there is provided a method according to aspect 74, wherein in the step of arranging the collecting device is unfolded at the pick-up means.

In accordance with a 76$^{th}$ aspect there is provided a method of handling rod-shaped components at a rig, preferably according to one or more of the aspects 42, 43, 49, 54, 60, 64, 69 and 71, comprising the step of applying at least one end cap to a rod-shaped component by an end cap applying means associated with the depositing means for rod-shaped components.

In accordance with a 77$^{th}$ aspect there is provided a method according to aspect 76, wherein in the applying step end caps are applied, preferably screwed, onto a rod-shaped component introduced to the depositing means by two end cap applying means to opposed end portions of the depositing means.

The invention claimed is:

1. An apparatus for handling at least one rod component at a rig comprising:

a depositing means for the rod components in which the rod components are deposited, substantially in parallel to a connecting line between a center of a drill hole and a center of a drilling mast, a lifting means including a lift carriage, a guide means for guiding the lift carriage and a drive for displacing the lift carriage in a displacing direction, a pick-up means attached to the lift carriage for picking up the rod component from the depositing means, wherein the pick-up means pivots with respect to the lift carriage at a plane perpendicular to the displacing direction (Z) of the lift carriage such that the rod components are arranged above the drill hole, and a plurality of monitor means in the depositing means, the lifting means, and the pick-up means for automatically monitoring the movement of the rod components amongst the depositing means, the lifting means, and the pick-up means.

2. The apparatus for handling at least one rod component at a rig according to claim 1, comprising:

a transport means for the rod components from an intermediate depositing means to the depositing means for the rod components from which the at least one rod component are picked up at a time by the pick-up means, and a control means for the transport means by which the transport means is controllable in such manner that at least one rod component is released at the depositing means in response to a position of the transport means relative to the depositing means.

3. The apparatus according to claim 2, comprising a detecting means for detecting a load relief at the transport means for application to the depositing means.

4. The apparatus according to claim 2, comprising a detecting means at the depositing means.

5. The apparatus according to claim 2, wherein the control means permit release of the at least one rod component in response to a predetermined position relative to the depositing means.

6. The apparatus according to claim 2, further comprising the detecting means for the position of the at least one rod component at the transport means relative to the depositing means, and in response to an output signal of the detecting means for the relative position, the control means permits a movement of the at least one rod component at the transport means within a predetermined zone only.

7. The apparatus for handling at least one rod component at a rig according to claim 1, further comprising the depositing means for the at least one rod component including at least a transfer means for a separate removal of the at least one rod component by the pick-up means into which the at least one rod component is introduced by one of a) the transport means for the transport of the at least one rod component to the depositing means, or b) a separating means provided at the depositing means in response to a detecting signal for the position of the at least one rod component at the depositing, means.

8. The apparatus according to claim 7, wherein the depositing means has at least one conveying means.

9. The apparatus for handling at least one rod component at a rig according to claim 1, further comprising a detecting lever for use with the pick-up means.

10. The apparatus according to claim 9, wherein the lever is biased toward a zone defined between a pair of gripper aims.

11. The apparatus according to claim 9, further comprising a control means allowing a movement of the pick-up means only when at least one rod component is detected in the pick-up means.

12. The apparatus according to claim 9, further comprising a pressure detecting means at the pick-up means, wherein a control means allows a movement of the pick-up means only when the rod component is detected in the pick-up means and when a predetermined closing pressure is detected.

13. The apparatus according to claim 12, further comprising a pair of gripper arms that are mechanically connected such that the pair of gripper arms are only movable about a same respective angle.

14. The apparatus for handling at least one rod component at a rig according to claim 1, comprising a detecting means for the rod component at the lifting means arranged above the drill hole.

15. The apparatus according to claim 14, further comprising:

the pick-up means for the rod component by which the rod component is transferred to the lifting means and which is movable upward by the lifting means, and a control means allowing a movement of the lifting means with the rod component independent of the pick-up means only after the pick-up means has been lifted above the rod component by the lifting means.

16. The apparatus for handling at least one rod component at a rig, according to claim 1, further comprising:

a detecting means for a position of the pick-up means and a control means permitting an opening of the pick-up means when the rod component is introduced only above the depositing means and adjacent to the lifting means above the drill hole and with closed safety brackets adjacent to a transfer means.

17. A. method of handling at least one rod component at a rig, comprising the steps of:

depositing at least one rod component in a depositing means, substantially parallel to a connecting line between a drill hole center and a center of a drilling mast, picking up at least one rod component from the depositing means by a pick-up means mounted at a lift carriage, wherein the lift carriage forms a lifting means with a guide means for guiding the lift carriage and a drive for displacing the lift carriage, and pivoting the pick-up means with respect to the lift carriage in a plane perpendicular to the displacing direction of the lift carriage such that the rod component is arranged above the drill hole, and monitoring the movement of the rod components amongst the depositing means, the lifting means, and the pick-up means by a plurality of sensors.

18. The method of handling at least one rod component at a rig according to claim 17 further comprising the steps of:

transporting the at least one rod components by a transport means from an intermediate depositing means to the depositing means for the at least one rod component, picking up at least one rod component at a time by the pick-up means, detecting a position of at least one rod component at the transport means relative to the depositing means, and controlling the transport means by a control means in such manner that at least one of the rod components is released at the depositing means in response to the position of the transport means relative to the depositing means.

19. The method according to claim 18, further comprising the step of releasing the at least one rod component in response to a predetermined position relative to the depositing means during the control step.

20. The method according to claim 18, further comprising the step of detecting the position of the at least one rod component at the transport means relative to the depositing means prior to the control step, and allowing a movement of at least one rod component in response to an output signal of a detecting means during the control step.

21. The method of handling rod components at a rig according to claim 17, further comprising the step of introducing one of:

a) at least one rod component into a transfer means for individual removal of at least one rod component by the pick-up means by the transport means for the transport of the rod components to the depositing means for the rod components, or b) at least one rod component into a transfer means for the individual removal of at least one rod component by the pick-up means by the separating means provided at the depositing means in response to a detecting signal for the position of the at least one rod component at the depositing means.

22. The method according to claim 21, further comprising the step of transporting at least one rod component to the pick-up means via at least one catch arranged at a conveyor chain.

23. The method of handling rod components at a rig according to claim 17, further comprising the steps of:

picking up at least one rod component by the pick-up means, and detecting the rod component in the pick-up means via a detecting lever.

24. The method according to claim 23, further comprising the step of biasing the lever.

25. The method according to claim 23, further comprising the step of permitting a movement of the pick-up means only when the rod component is detected in the pick-up means.

26. The method according to claim 23, further comprising the step of permitting a movement of the pick-up means only when at least one rod component is detected in the pick-up means, and closing the pick-up means when a pressure detecting means for closing a pair of gripper arms at the pick-up means is triggered.

27. The method of handling rod components at a rig according to claim 17, further comprising the step of detecting the rod component by a detecting means at the lifting means arranged above the drill hole.

28. The method according to claim 27, further comprising the steps of:

transferring the at least one rod component by the pick-up means to the lifting means, and moving the lifting means upward and permitting a movement of the lifting means with the rod component independent, of the pick-up means only after the pick-up means has been lifted above the rod component by the lifting means.

29. The method of handling rod components at a rig according to claim 17 further comprising the steps of:

detecting a position of the pick-up means by a detecting means, and allowing the pick-up means to open when the rod component is above the depositing means and adjacent to the lifting means above the drill hole.

30. An apparatus for handling at least one rod component at a rig, comprising:

a depositing means for the rod components in which the rod components are deposited, substantially in parallel to a connecting line between a center of a drill hole and a center of a drilling mast, a lifting means including a lift carriage, a guide means for guiding the lift carriage and a drive for displacing the lift carriage in a displacing direction, a pick-up means attached to the lift carriage for picking up the rod component from the depositing means, wherein the pick-up means pivots with respect to the lift carriage at a plane perpendicular to the displacing direction (Z) of the lift carriage such that the rod components are arranged above the drill hole, the depositing means having a means for measuring the length of the rod component, wherein the length measuring means either a) includes at least two mechanical detecting means by which the respective introduced rod component and the position thereof relative to the depositing means are detectable, or b) includes a detecting means for contact-free detection of the rod component at a predetermined position.

31. The apparatus according to claim 30, further comprising a detecting signal that is triggered when the rod component is introduced to the detecting means.

32. The apparatus according to claim 30, wherein at least two detecting means for contact-free detection are provided by which a first end portion and a second end portion of the rod component are detected by the detecting means, wherein the first and second end portions are located on opposed ends of the longitudinal direction of the rod-shaped component.

33. The apparatus according to claim 30, wherein the length measuring means comprises a moving means for moving the at least one rod component introduced to the depositing means in a longitudinal direction.

34. The apparatus according to claim 30, further comprising a detecting means attached to the lifting means, the detecting means pivoting in a plane perpendicular to the lifting direction which triggers the detecting means for presence of the rod component in the lifting means.

35. A method of handling at least one rod component at a rig, comprising the steps of:

depositing at least one rod component in a depositing means, substantially parallel to a connecting line between a drill hole center and a center of a drilling mast, picking up at least one rod component from the depositing means by a pick-up means mounted at a lift carriage, wherein the lift carriage forms a lifting means with a guide means for guiding the lift carriage and a drive for displacing the lift carriage, and pivoting the pick-up means with respect to the lift carriage in a plane perpendicular to the displacing direction of the lift carriage such that the rod component is arranged above the drill hole, and measuring a length of at least one rod component in the depositing means in which either:

a) the introduced rod component is detected by at least two mechanical detecting means, or b) the rod component is detected contact-free at a predetermined position by a detecting means.

36. The method according to claim 35, further comprising the step of triggering a detecting signal by a movement of a lever in the detecting step when at least one rod component is introduced, the lever being biased into an introducing recess for at least one rod component.

37. The method according to claim 35, further comprising the step of detecting two end portions of the rod component contact-free by at least two detecting means, wherein the two end portions are located on opposite ends of the longitudinal length of the rod.

38. The method according to claim 35, further comprising the step of performing the contract-free detection through light by means of a light barrier.

39. The method according to claim 35, further comprising the step of moving the at least one rod component introduced to the depositing means in the at least one rod component's longitudinal direction by a moving means.

40. The method according to claim 35, further comprising the step of detecting the movement of a mechanical lever mounted at the lifting means and pivoting in a plane perpendicular to the lifting direction by a detecting means, wherein the detecting means is triggered by the lever for the presence of the rod component in the lifting means.

* * * * *